United States Patent [19]

Ikegawa et al.

[11] Patent Number: 5,008,181

[45] **Date of Patent: * Apr. 16, 1991**

[54] SILVER HALIDE PHOTOGRAPHIC MATERIALS

[75] Inventors: Akihiko Ikegawa; Masaki Okazaki; Tadao Sugimoto, all of Kanagawa, Japan

[73] Assignee: Fuji Photo Film Co., Tokyo, Japan

[ * ] Notice: The portion of the term of this patent subsequent to May 8, 2007 has been disclaimed.

[21] Appl. No.: 248,747

[22] Filed: Sep. 26, 1988

[30] Foreign Application Priority Data

Sep. 25, 1987 [JP] Japan ..... 62-239034

[51] Int. Cl.[5] ..... G03C 1/28; G03C 1/29

[52] U.S. Cl. ..... 430/572; 430/570; 430/576; 430/955; 430/958

[58] Field of Search ..... 430/570, 572, 576, 585, 430/223, 513, 559, 955, 958

[56] References Cited

U.S. PATENT DOCUMENTS

| | | | |
|---|---|---|---|
| 3,395,017 | 7/1968 | Knott | 430/585 |
| 3,660,103 | 5/1972 | Kampfer et al. | 430/585 |
| 4,248,962 | 2/1981 | Lau | 430/382 |
| 4,770,990 | 9/1988 | Nakamura et al. | 430/564 |
| 4,820,606 | 4/1989 | Miyasaka et al. | 430/139 |

*Primary Examiner*—Charles L. Bowers, Jr.
*Assistant Examiner*—Mark R. Buscher
*Attorney, Agent, or Firm*—Sughrue, Mion, Zinn Macpeak & Seas

[57] ABSTRACT

A silver halide photographic material comprising a support having thereon at least one silver halide emulsion layer spectrally sensitized by at least one adsorptive spectral sensitizing dye, wherein the emulsion layer or a hydrophilic colloid layer adjacent to the emulsion layer contains at least one compound represented by following formula (I), (II), or (III);

(I)

$A_2$+Time$_1$)$_{l1}$X (II)

$A_3$+Time$_2$)$_{l2}$Y (III)

(all the symbols of which are defined in the specification) are disclosed.

8 Claims, No Drawings

SILVER HALIDE PHOTOGRAPHIC MATERIALS

FIELD OF THE INVENTION

This invention relates to a novel technique for dye spectral sensitization of silver halide photographic materials.

More specifically, the invention relates to a silver halide photographic material the spectral sensitivity of which is greatly improved by incorporating a light-collecting dye having a high light emitting property in the dispersion medium of a light-sensitive silver halide emulsion(s) spectrally sensitized by an adsorptive dye or in another hydrophilic colloid layer.

This invention relates to a fundamental technique for spectral sensitization of silver halide photographic materials and the field of this invention covers all silver halide photographic materials including negative, positive, and reversal types as well as black-and-white photographic materials and color photographic materials.

BACKGROUND OF THE INVENTION

For the spectral sensitization of silver halides, spectral sensitizing dyes having an adsorptive property for silver halide (i.e., dyes acting as sensitizing dyes by adsorbing on the surface of silver halides) are generally used and spectral sensitization is attained by the injection of light-excited electrons from the dye adsorbed on the surface of the silver halide.

As such spectral sensitizing dyes, methine dyes which have an adsorptive property and a proper oxidation-reduction potential, such as cyanine dyes, merocyanine dyes, complex cyanine dyes, and complex merocyanine dyes are widely used. However, it is known that in spectral sensitization by these adsorptive dyes, there is a limit on the extent of the spectral sensitization attained since the amount adsorbed of the sensitizing dye on the surface of silver halide is limited, and that saturated adsorption of the dye or adsorption similar to the saturated adsorption frequently causes remarkable desensitization (dye desensitization). Thus, attempts to perform spectral sensitization with non-adsorbed dye molecule utilizing energy transfer from a dye molecule in the non-adsorbed state, to an adsorbed sensitizing dye molecule without the need for adsorption of the dye onto the surface of silver halide are disclosed, for example, in JP-A-51-117619, 62-239143, 63-138341 and 63-138342 (the term "JP-A" as used herein refers to a "published unexamined Japanese patent application").

In these attempts, after spectrally sensitizing silver halide grains by adsorptive dye(s) to optimum sensitivity, an energy transfer type dye is added to the binder at a high concentration to utilize the light-collecting effect of the energy transfer type dye, whereby an increase in spectral sensitization (hereinafter referred to as light-collecting sensitization) is attained.

In light-collecting sensitization, a high light-collecting sensitization effect is obtained in a system having a sufficiently high concentration of an energy transfer type dye (light-collecting dye) in the binder of a silver halide emulsion. Similarly, in regard to an adsorptive sensitizing dye which is an energy acceptor, the use of silver halide grains having a larger specific surface area and, hence, a larger amount of adsorbed sensitizing dye per emulsion grain, such as tabular silver halide grains, gives a higher light-collecting sensitization as disclosed in the example of JP-A-63-138342. In other words, a silver halide emulsion system having a larger amount of adsorbed spectral sensitizing dye per silver halide grain shows a more improved light-collecting sensitization effect.

However, in conventional light-collecting sensitization, since the light-collecting dye is of the non-adsorptive type for silver halide grains, it sometimes happens that in the system of a multilayer silver halide photographic material, in particular, a multilayer color photographic material, the light-collecting dye diffuses into other layer(s) than the layer in which the dye was incorporated to cause photographically undesirable effects in the diffused layer(s) such as desensitization by a filter effect, unnecessary spectral sensitization at a long wavelength region, color mixing, etc.

Also, in conventional light-collecting sensitization, energy is transmitted from the light-collecting dye to a spectral sensitizing dye adsorbed on the surface of the silver halide by energy transfer. However, it sometimes happens that if the distance between the light-collecting dye and the spectral sensitizing dye is increased by diffusion of the light-collecting dye, the energy transmitting effect is reduced to cause an effect similar to that of a filter dye in simply absorbing light contributing to the sensitization effect, whereby desensitization occurs instead of sensitization.

SUMMARY OF THE INVENTION

As a result of various investigations to improve the aforesaid points, the inventors discovered a manner of fixing a light-collecting dye in a desired layer of a multilayer silver halide photographic material and reducing the aforesaid undesirable influences due to the diffusion of the light-collecting dye.

A first object of this invention is to provide a silver halide photographic material having greatly improved spectral sensitization.

A second object of this invention is to provide a silver halide photographic material wherein a light-collecting dye is fixed in a definite light-sensitive silver halide emulsion layer(s) or a hydrophilic colloid layer adjacent to a silver halide emulsion layer at the time of exposure to light to inhibit desensitizing based on diffusion of the light-collecting dye into other layer(s), and also the light-collecting dye is easily released from the photographic material at processing to cause no color residue.

The aforesaid objects of this invention have been attained by a silver halide photographic material of this invention as set forth below.

That is, according to this invention, there is provided a silver halide photographic material comprising a support having thereon at least one silver halide emulsion layer spectrally sensitized by an adsorptive spectral sensitizing dye, wherein the emulsion layer or a hydrophilic colloid layer adjacent to the emulsion layer contains at least one compound represented by the following formulae (I), (II) or (III):

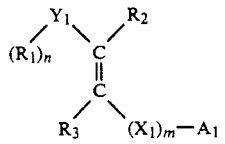

(I)

wherein $R_1$ represents a hydrogen atom or a group which may be substituted; $R_2$ and $R_3$ each independently represents a hydrogen atom or a group which may be substituted; $R_1$ and $R_2$ or $R_1$ and $R_3$ may combine with each other to form a carbon ring having 5 to 7 carbon atoms or a heterocyclic ring; $Y_1$ represents

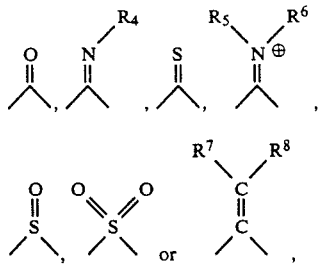

wherein $R_4$, $R_5$, $R_6$, $R_7$ and $R_8$ each independently represents a hydrogen atom or a group which may be substituted, a cyano group or a nitro group; $A_1$ represents a light-collecting dye moiety which has the absorption maximum in the region of 300 nm or longer (the maximum is 700 nm), the light-collecting dye simultaneously satisfies, the following factors (1) and (2), and is bonded to $X_1$ or the carbon atom through the hetero atom of $A_1$; $X_1$ represents a divalent linkage group bonded to the carbon atom through the hetero group of $X_1$; and m and n each represents 0 or 1;

(1) The luminous quantum yield of the dye is at least 0.001 at room temperature and at a concentration of $10^{-4}$ mol/dm$^3$ in dry gelatin, and (2) The dye has a luminous zone at least partially overlapping with the optical absorption zone of the adsorptive spectral sensitizing dye adsorbed in a silver halide (10 to 100% overlap based on the width of the optical absorption zone);

$$A_2\text{—Time}_1)_{t1}X \qquad \text{(II)}$$

wherein X is an oxidation reduction nucleus which is an atomic group capable of releasing $(\text{Time}_1)_{t1}A_2$ upon being oxidized during photographic processing; $\text{Time}_1$ represents a timing group bonded to X with a sulfur atom, a nitrogen atom, an oxygen atom, or a selenium atom included in the timing group; $t_1$ represents 0 or 1; and $A_2$ has the same significance as $A_1$;

$$A_3\text{—Time}_2)_{t2}Y \qquad \text{(III)}$$

wherein Y is a coupler residue and represents an atomic group capable of releasing $\text{—Time}_2)_{t3}A_3$ upon coupling with the oxidation product of a color developing agent during photographic processing; $\text{Time}_2$ represents a timing group bonding to Y with a sulfur atom, a nitrogen atom, an oxygen atom, or a selenium atom included in the timing group; $A_3$ has the same significance as $A_1$ described above; and $t_2$ has the same significance as $t_1$.

DETAILED DESCRIPTION OF THE INVENTION

In formula (I), the light-collecting dye shown by $A_1$ is required to have a luminous quantum yield of at least 0.001, preferably at least 0.1, and more preferably at least 0.5. The maximum luminous quantum yield is about 1. The luminous quantum yield can be measured according to the method described in detail in JP-A-63-138341.

The structure of the light-collecting dye shown by $A_1$ is preferably from the cyanine dye from the point of luminous quantum yield. In regard to cyanine dyes, the fluorescent yields of dyes in solution or another matrix are reported in D. F. O'Brien et al., *Photo. Sci. Eng.*, Vol. 18, 76 (1974) and that of oxacarbocyanine derivatives in gelatin is reported to be about 0.75. As types of dyes having a high luminous quantum yield, there are typically those having the skeletal structure of dyes used in dye lasers. These dyes are recited in Mitsuo Maeda, *Laser Kenkyu (Research)*, Vol. 8, pages 694, 803, and 958 (1980), *ibid.*, 85 (1981), and F. P. Schaefer, *Dye Lasers*, Springer, 1973.

Typical examples of the light-collecting dyes shown by $A_1$ in formula (I) are illustrated below, although they are not limitative.

I Cyanine dyes and merocyanine dyes
II Xanthene dyes
III Acridine dyes
IV Oxazine dyes
V Thiazine dyes
VI Riboflavin dyes
VII Triarylmethane dyes
VIII Aminonaphthalene dyes
IX Pyrene dyes
X Coumarin dyes
XI Porphyrin dyes
XII Phthalocyanine dyes In these dyes, particularly preferred dyes are the dyes of group I and the dyes of group II. The cyanine dyes of group I are most preferred. Also, in the dyes of group II, water-soluble rhodamine derivatives (Rhodamine B, Sulforhodamine B, Sulforhodamine 101, etc.) are preferred from the view of a high luminous quantum yield.

The compounds shown by formula (I) described above release the light-collecting dye by the addition of a nucleophilic agent to the unsaturated bond thereof on photographic processing.

As methods of blocking an active group utilizing the addition of a nucleophilic agent to an unsaturated bond, those described in JP-A-59-201057, 61-43739 and 61-95347 may be used.

The light-collecting dye shown by $A_1$ may be bonded through the hetero atom of $A_1$ (e.g., sulfur, nitrogen, oxygen or selenium) to the carbon atom directly (m=0) or via $X_1$ (m=1).

$X_1$ represents a divalent linkage group, which is bonded to the carbon atom through a hetero atom (e.g., sulfur, nitrogen, oxygen or selenium) and after being cleaved as $X_1$-$A_1$ on photographic processing, quickly releases $A_1$.

Examples of such a linkage group are linkage groups releasing $A_1$ by an intramolecular ring closing reaction as described in British Patent Publication (unexamined) 2,010,818A, U.S. Pat. Nos. 4,248,962 and 4,409,323, and British Patent 2,096,783, linkage groups releasing $A_1$ by an intramolecular electron transfer as described in British Patent 2,072,363 and JP-A-57-154234, linkage groups releasing $A_1$ with the release of carbon dioxide gas as described in JP-A-57-179842, and linkage groups releasing $A_1$ with the release of formalin as described in JP-A-59-93422.

Then, typical structures of $X_1$- are now illustrated together with $A_1$.

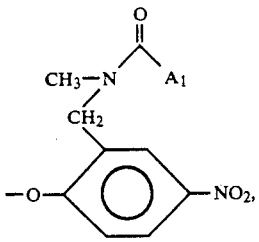

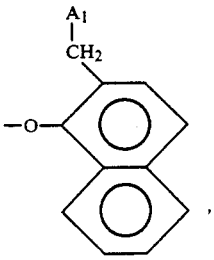

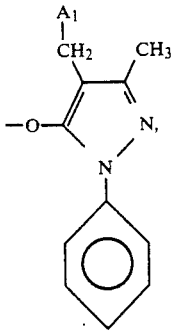

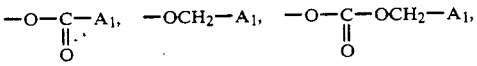

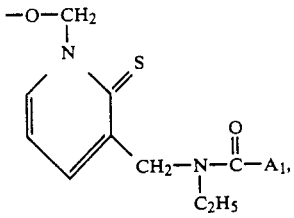

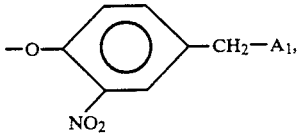

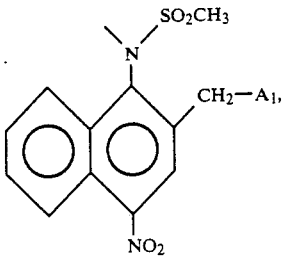

-continued

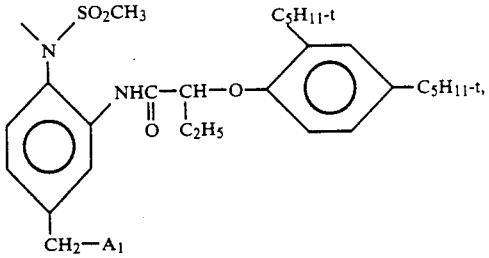

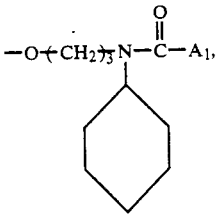

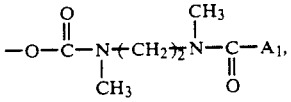

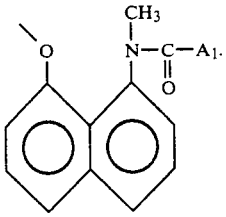

Then, the compound shown by formula (I) described above is explained in detail.

In formula (I), $R_1$ represents a hydrogen atom or a group which may be substituted, such as an alkyl group (preferably having from 1 to 20 carbon atoms), an alkenyl group (preferably having from 2 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an amino group (unsubstituted amino and secondary or tertiary amino substituted by alkyl having from 1 to 20 carbon atoms or aryl having from 6 to 20 carbon atoms), a hydroxy group, etc. These groups each may have at least one substituent as described and when the group has 2 or more substituents, they may be the same or different.

Examples of the aforesaid at least one substituent are a halogen atom (e.g., fluorine, chlorine and bromine), an alkyl group (preferably having from 1 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an acyl group (preferably having from 2 to 20 carbon atoms), an acylamino group (preferably alkanoylamino having from 1 to 20 carbon atoms or benzylamino having from 6 to 20 carbon atoms), a nitro group, a cyano group, an oxycarbonyl group (preferably alkoxycarbonyl having from 1 to 20 carbon atoms or aryloxycarbonyl having from 6 to 20 carbon atoms), a hydroxy group, a carboxy group, a sulfo group, a ureido group (preferably alkylureido having from 1 to 20 carbon atoms or arylureido having from 6 to 20 carbon atoms), a sulfonamido group (preferably alkylsulfonamido having from 1 to 20 carbon atoms or arylsulfonamido having from 6 to 20 carbon atoms), a sulfamoyl group (preferably alkylsulfamoyl having from 1 to 20 carbon atoms or arylsulfamoyl having from 6 to 20 carbon atoms), a carbamoyl group (preferably alkylcarbamoyl having from 1 to 20 carbon atoms or arylcarbamoyl having from 6 to 20 carbon atoms), an acyloxy group (preferably having from 1 to 20 carbon atoms), an amino group (unsubstituted amino or secondary or tertiary amino substituted by, preferably, alkyl having from 1 to 20 carbon atoms or aryl having from 6 to 20 carbon atoms), a carbonic acid ester group (preferably alkyl carbonic acid ester having from 1 to 20 carbon atoms or aryl carbonic acid ester having from 6 to 20 carbon atoms), a sulfone group (preferably alkylsulfone having from 1 to 20 carbon atoms or arylsulfone having from 6 to 20 carbon atoms), and a sulfinyl group (preferably alkylsulfinyl having from 1 to 20 carbon atoms or arylsulfinyl having from 6 to 20 carbon atoms).

In formula (I), $R_1$ may combine with $R_2$ or $R_3$ to form a carbon ring or a heterocyclic ring (e.g., a 5-membered to 7-membered ring).

In formula (I), $R_2$ and $R_3$, which may be the same or different, each represents a hydrogen atom or a a halogen atom (e.g., fluorine, chlorine and bromine) or a group which may be substituted. Examples of the group which may be substituted are an alkyl group (preferably having from 1 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an acyloxy group (preferably having from 2 to 20 carbon atoms), an amino group (unsubstituted amino or secondary or tertiary amino substituted by, preferably, alkyl having from 1 to 20 carbon atoms or aryl having from 6 to 20 carbon atoms), a carbonamido group (preferably alkylcarbonamido having from 1 to 20 carbon atoms or arylcarbonamido having from 6 to 20 carbon atoms), a ureido group (preferably alkylureido having from 1 to 20 carbon atoms or arylureido having from 6 to 20 carbon atoms), a carboxy group, a carbonic acid ester group (preferably alkylcarbonic acid ester having from 1 to 20 carbon atoms or arylcarbonic acid ester having from 6 to 20 carbon atoms), an oxycarbonyl group (preferably alkyloxycarbonyl having from 1 to 20 carbon atoms or aryloxycarbonyl having from 6 to 20 carbon atoms), a carbamoyl group (preferably alkylcarbamoyl having from 1 to 20 carbon atoms or arylcarbamoyl having from 6 to 20 carbon atoms), an acyl group (preferably alkylcarbonyl having from 1 to 20 carbon atoms or arylcarbonyl having from 6 to 20 carbon atoms), a sulfo group, a sulfonyl group (preferably alkylsulfonyl having from 1 to 20 carbon atoms or arylsulfonyl having from 6 to 20 carbon atoms), a sulfinyl group (preferably alkylsulfinyl having from 1 to 20 carbon atoms or arylsulfinyl having from 6 to 20 carbon atoms), a sulfamoyl group (preferably alkylsulfamoyl having from 1 to 20 carbon atoms or arylsulfamoyl having from 6 to 20 carbon atoms), a cyano group, and a nitro group.

The groups shown by $R_2$ and $R_3$ may have one or more substituents (maximally 20 substituents) and when two or more substituents exist, they may be the same or different. Substituents for these groups shown by $R_2$ and $R_3$ are the same as the substituents for $R_1$ described above.

In formula (I), $Y_1$ represents:

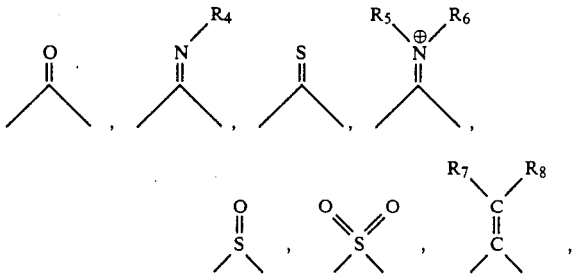

a cyano group or a nitro group. In the above formulae, $R_4$, $R_5$, $R_6$, $R_7$ and $R_8$ may be the same or different, and each represents a hydrogen atom or a group which may be substituted, such as, an alkyl group (preferably having from 1 to 20 carbon atoms), an alkenyl group (preferably having from 2 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an acyloxy group (preferably having from 2 to 20 carbon atoms), an amino group (unsubstituted amino group or secondary or tertiary amino group substituted by, preferably, an alkyl group having from 1 to 20 carbon atoms or an aryl group having from 6 to 20 carbon atoms), a carbonamido group (preferably alkylcarbonamido having from 1 to 20 carbon atoms or arylcarbonamido having from 6 to 20 carbon atoms), a ureido group (preferably alkylureido having from 1 to 20 carbon atoms or arylureido having from 6 to 20 carbon atoms), an oxycarbonyl group (preferably alkyloxycarbonyl having from 1 to 20 carbon atoms or aryloxycarbonyl having from 6 to 20 carbon atoms), a carbamoyl group (preferably alkylcarbamoyl having from 1 to 20 carbon atoms or arylcarbamoyl having from 6 to 20 carbon atoms), an acyl group (preferably alkylcarbonyl having from 1 to 20 carbon atoms or arylcarbonyl having from 6 to 20 carbon atoms), a sulfonyl group (preferably alkylsulfonyl having from 1 to 20 carbon atoms or arylsulfonyl having from 6 to 20 carbon atoms), a sulfinyl group (preferably alkylsulfinyl group having from 1 to 20 carbon atoms or arylsulfinyl group from 6 to 20 carbon atoms), and a sulfamoyl group (preferably alkylsulfamoyl having from 1 to 20 carbon atoms or arylsulfamoyl having from 6 to 20 carbon atoms).

Of the groups shown by $R_7$ and $R_8$, preferred groups are an oxycarbonyl group, a carbamoyl group, an acyl group, a sulfonyl group, a sulfamoyl group, a sulfinyl group, a cyano group, and a nitro group.

The aforesaid groups may be substituted by one or more substituents and when two or more substituents exist, they may be the same or different. Practical substituents are the same as the substituents for $R_1$ described above.

As preferred compounds in the compounds shown by formula (I) described above, there are compounds shown by formula (A) and compounds shown by formula (B):

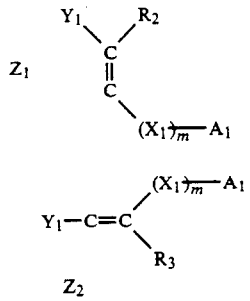

(A)

(B)

In formula (A) above, $Z_1$ represents an atomic group necessary for forming a carbon ring or a heterocyclic ring, such as, practically, a 5-membered, 6-membered or 7-membered carbon ring or a 5-membered, 6-membered or 7-membered heterocyclic ring containing at least one nitrogen, oxygen or sulfur atom. The carbon ring or the heterocyclic ring may form a condensed ring at a proper position thereof.

Practical examples of the carbon ring and the heterocyclic ring are cyclopentenone, cyclohexenone, cycloheptenone, benzocycloheptenone, benzocyclopentenone, benzocyclohexenone, 4-pyridone, 4-quinolone, 2-pyrone, 4-pyrone, 1-thio-2-pyrone, 1-thio-4-pyrone, coumarin, chromone, uracil, etc., and also as follows:

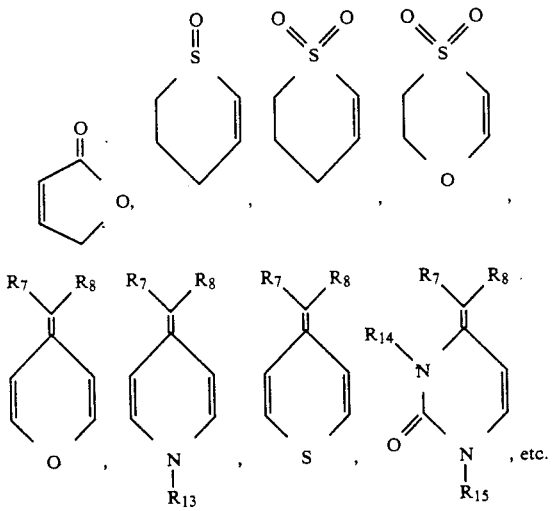

wherein $R_{13}$, $R_{14}$ and $R_{15}$ each represents a hydrogen atom, an alkyl group, an alkenyl group, an aryl group, an aralkyl group, or an acyl group each group of which has not more than 20 carbon atoms, and $R_7$ and $R_8$ are the same as those shown above in formula (I).

The aforesaid carbon ring or the heterocyclic ring may have one or more substituents and when two or more substituents exist, they may be the same or different. Practical substituents are the same as those for $R_1$ described above.

Also, in formula (B) described above, $Z_2$ has the same significance as $Z_1$ in formula (A) and is practically cyclopentanone, cyclohexanone, cycloheptanone, benzocycloheptanone, benzocyclopentanone, benzocyclohexanone, 4-tetrahydropyridone, 4-dihydroquinone, 4-tetrahydropyrone, etc. These carbon ring and heterocyclic ring each may be substituted by one or more substituent and when two or more substituents exist, they may be the same or different. Practical substituents are the same as those for $R_1$ described above.

In formulae (A) and (B), $R_2$, $R_3$, $X_1$, $Y_1$, $A_1$ and m have the same significance as defined in formula (I).

The compounds of formula (I) for use in this invention may be partially adsorbed onto silver halide grains in a silver halide emulsion layer, but for attaining the purpose of light-collecting sensitization of this invention, it is desirable that the compounds shown by formula (I) do not disturb the adsorption of a spectral sensitizing dye(s) onto the silver halide grains.

In formula (I), the selection of groups shown by $R_1$, $R_2$, $R_3$, $R_4$, $R_5$, $R_6$, $R_7$ and $R_8$ is made according to the pH and the composition of a processing solution for processing the photographic light-sensitive material containing the compound shown by formula (I) and the timing time required.

Also, for compounds of formula (I) for use in this invention, the releasing speed of the light-collecting dye can be widely controlled not only by the pH at processing but also by the use of a nucleophilic material such as, in particular, sulfite ions, hydroxylamine, thiosulfate ions, metahydrogensulfite ions, hydroxamic acid and similar compounds described in JP-A-59-198453, the oxime compounds described in JP-A-60-35729, as well as dihydroxybenzene developing agents, 1-phenyl-3-pyrazolidone developing agents, p-aminophenol developing agents, etc., as described hereinafter.

By using the aforesaid nucleophilic material, the releasing speed of the collecting dye can be increased and the addition amount thereof is preferably from about $10^2$ to $10^6$ molar times the compound of formula (I).

The compounds for use in this invention shown by formula (II) are now described in detail.

First, X in formula (II) is explained in detail.

Examples of the oxidation reduction nucleus shown by X are hydroquinone, catechol, p-aminophenol, o-aminophenol, 1,2-naphthalenediol, 1,4-naphthalenediol, 1,6-naphthalenediol, 1,2-aminonaphthol, 1,4-aminonaphthol and 1,6-aminonaphthol. In this case, it is preferred that the amino group included in X be substituted by a sulfonyl group having from 1 to 25 carbon atoms or an acyl group having from 1 to 25 carbon atoms. As the sulfonyl group for the amino group, there are substituted or unsubstituted aliphatic sulfonyl groups and aromatic sulfonyl groups. As the acyl group, there are substituted or unsubstituted aliphatic or aromatic acyl groups.

The hydroxy group or the amino group forming the oxidation reduction nucleus shown by X and included in X may be protected by a protective group which can be released at photographic processing. The protective group has, for example, rom 1 to 25 carbon atoms and examples thereof are an acyl group, an alkoxycarbonyl group, a carbamoyl group and the protective groups described in JP-A-59-197037 and 59-201057. Furthermore, the protective group may, if possible, combine with the substituent for X described below to form a 5-, 6- or 7-membered ring.

The oxidation reduction nuclei shown by X may be substituted by a proper substituent at a proper position. Examples of the substituent are an alkyl group (preferably having 1 to 20 carbon atoms), an aryl group (preferably having 6 to 20 carbon atoms), an alkylthio group (preferably having 1 to 20 carbon atoms), an arylthio group (preferably having from 6 to 20 carbon atoms), an alkoxy group (preferably having 1 to 20 carbon atoms), an aryloxy group (preferably having 6 to 20 carbon atoms), an amino group, an amido group, a sulfonamido group, an alkoxycarbonylamino group (preferably having 2 to 21 carbon atoms), a ureido group, a carbamoyl group, an alkoxycarbonyl group (preferably having 2 to 21 carbon atoms), a sulfamoyl group, a sulfonyl group, a cyano group, a halogen atom, an acyl group (preferably having 2 to 21 carbon atoms), a carboxy group, a sulfo group, a nitro group, a heterocyclic residue (preferably having 1 to 30 carbon atoms) and the group shown by —$Time_1)_{t1}A_2$. These substituents described above as a substituent for X each may be further substituted by the aforesaid substituent. Also, these substituents, if the nuclei have two or more substituents and if possible, may combine with each other to form a saturated or unsaturated carbon ring or a saturated or unsaturated heterocyclic ring.

The oxidation reduction nucleus shown by X is preferably hydroquinone, catechol, p-aminophenol, o-aminophenol, 1,4-naphthalenediol, and 1,4-aminonaphthol, more preferably hydroquinone, catechol, p-aminophenol and o-aminophenol, and most preferably hydroquinone.

Practical examples of the preferred oxidation reduction nucleus shown by X in formula (II) are shown below. In addition, * in each following structural formula shows the position of bonding to —$Time_1)_{t1}A_2$.

(1)

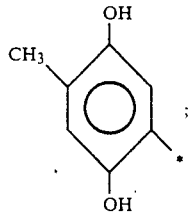

(2)

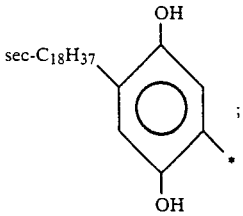

(3)

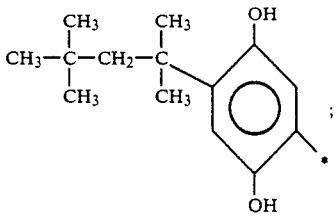

(4)

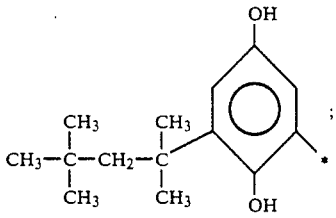

-continued (5)

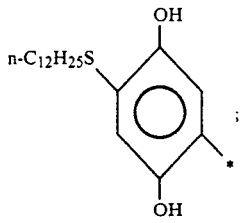

(6)

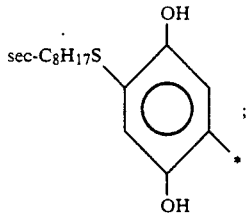

(7)

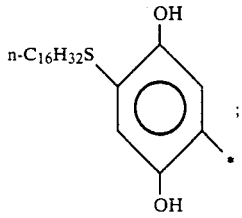

(8)

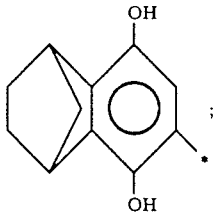

(9)

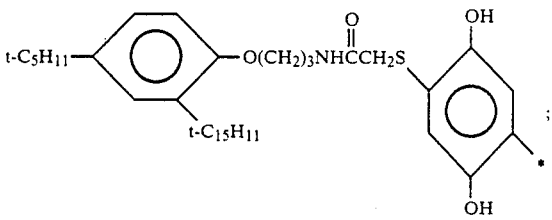

(10)

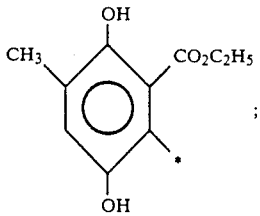

(11)

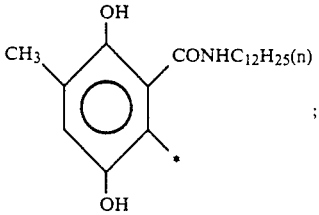

-continued
(12)
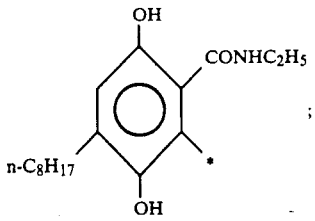
;
(13)
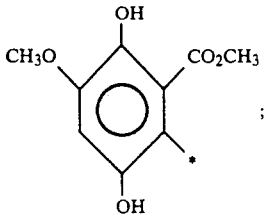
;
(14)
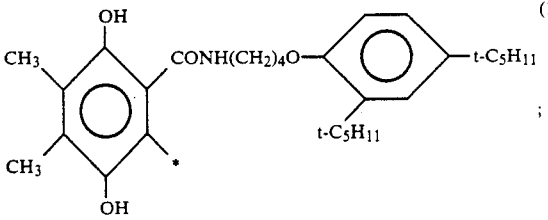
;
(15)
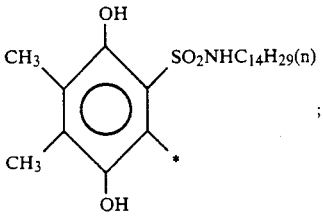
;
(16)
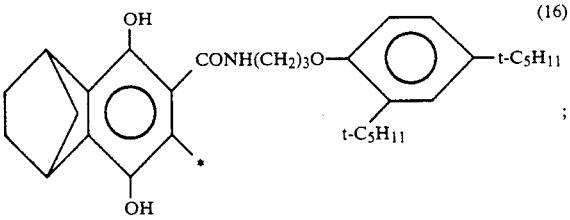
;
(17)
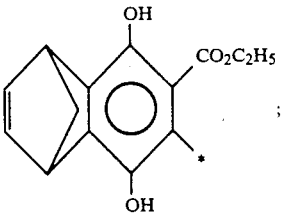
;
(18)
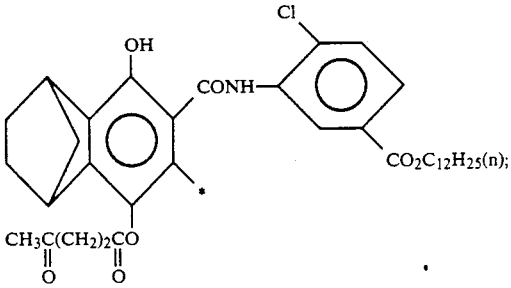
-continued
(19)
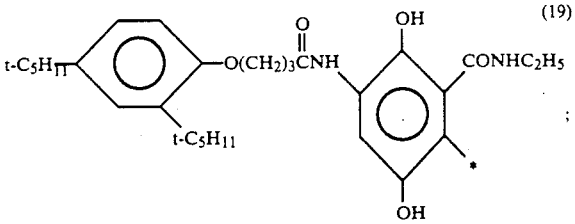
;
(20)
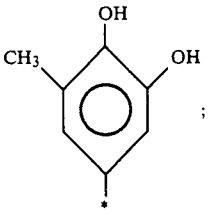
;
(21)
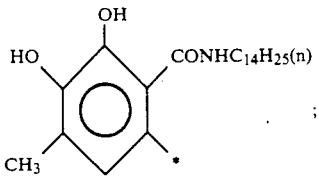
;
(22)
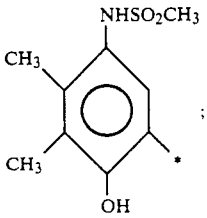
;
(23)
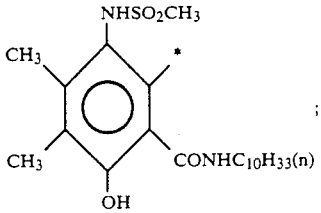
;
(24)
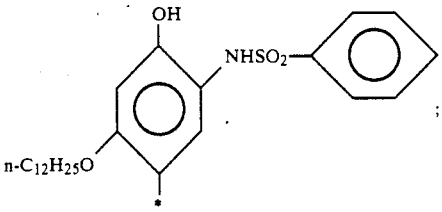
;
(25)
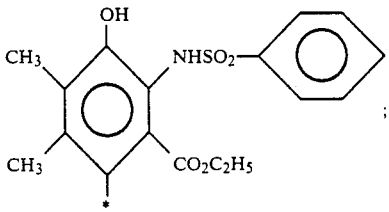
;

-continued (26)

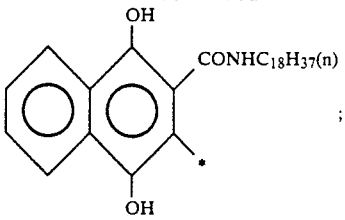

;

(27)

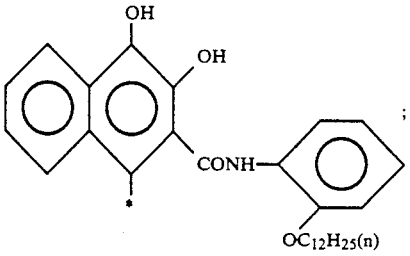

;

(28)

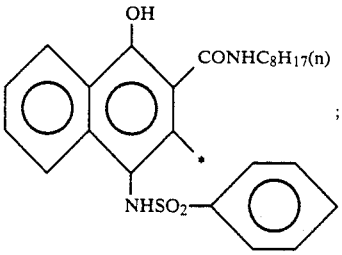

;

(29)

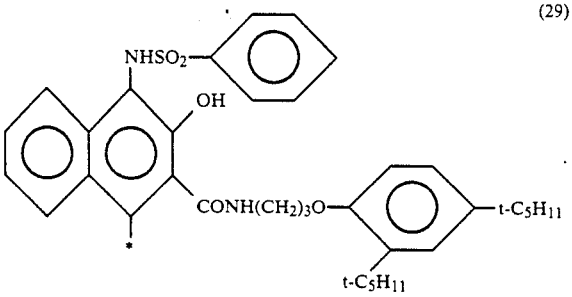

In formula (II) —Time$_1$)$_{t1}$A$_2$ is a group which is released as ⊖—Time$_1$)$_{t1}$A$_2$ when the oxidation reduction nucleus shown by X in formula (II) becomes an oxidation product due to a cross oxidation reaction at development.

(Time$_1$) is a timing group bonding to A$_2$ via a sulfur atom, a nitrogen atom, an oxygen atom, or a selenium atom and the group releases A$_2$ from ⊖—Time$_1$)$_{t1}$A$_2$ released at development through one or more reaction steps. Specific examples of the group shown by (Time$_1$) are described in U.S. Pat. Nos. 4,248,962, 4,409,323, 4,146,396, British patent 2,096,783, JP-A-51-146828 and 57-56837. They may be used singly or as a combination of them.

The compounds shown by formula (III) described above is described in detail.

In formula (III), Y is preferably a coupler residue shown by the following formula (Cp-1), (Cp-2), (Cp-3), (Cp-4), (Cp-5), (Cp-6), (Cp-7), (Cp-8) or (Cp-9) from the point of high coupling speed.

(Cp-1)

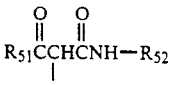

-continued (Cp-2)

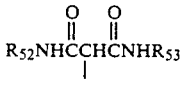

(Cp-3)

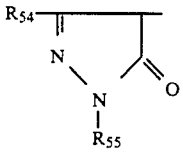

(Cp-4)

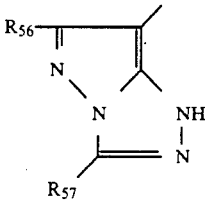

(Cp-5)

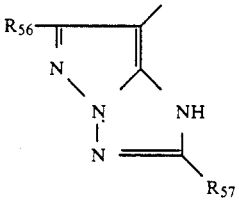

(Cp-6)

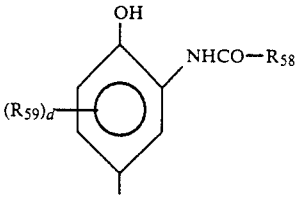

(Cp-7)

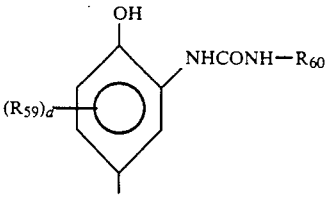

(Cp-8)

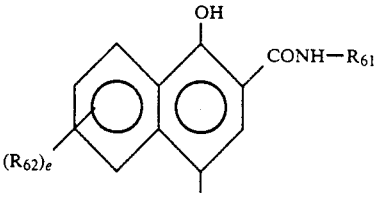

(Cp-9)

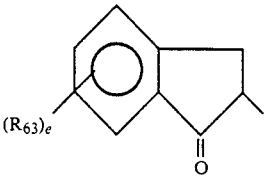

In the aforesaid formulae, the free bonding hand at each coupling portion means a position of bonding a coupling releasing group.

In the above formulae, when $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ includes a non-diffusible group, each is selected such that the total carbon atom number becomes from 8 to 40, and preferably from 10 to 30 and in other cases, each is selected such that the total carbon atom number is not more than 15. When the coupler shown by the aforesaid formula is a bis type coupler, a telomer type coupler or polymer type coupler, some of the aforesaid groups shown by $R_{51}$ to $R_{63}$ represent a divalent group bonding to a recurring unit (e.g., alkylene having from 1 to 20 carbon atoms, arylene having from 6 to 40 carbon atoms or divalent heterocyclic residue having 2 to 40 carbon atoms). In this case, the total carbon atom number may be outside the aforesaid ranges and preferably 8 to 50.

$R_{51}$ to $R_{63}$, d and e are now explained in detail.

In the following, $R_{41}$ represents an aliphatic group, an aromatic group or a heterocyclic group. $R_{42}$ represents an aromatic group or a heterocyclic group. $R_{43}$, $R_{44}$ and $R_{45}$ each represents a hydrogen atom, an aliphatic group, an aromatic group, or a heterocyclic group. $R_{51}$ has the same significance as $R_{41}$ and $R_{52}$ and $R_{53}$ each has the same significance as $R_{42}$. $R_{54}$ represents the same group as $R_{41}$, $R_{41}CON(R_{43})-$, $R_{41}N(R_{43})-$, $R_{45}SO_2N(R_{43})-$, $R_{41}S-$, $R_{43}O-$, $R_{45}-N(R_{43})-CO-N(R_{44})-$, $R_{41}OOC-$, $R_{44}N(R_{43})CO-$, or $N\equiv C-$.

$R_{55}$ has the same significance as $R_{41}$. $R_{56}$ and $R_{57}$ each represents the same group as $R_{43}$, $R_{41}S-$, $R_{43}O-$, $R_{41}CON(R_{43})-$, $R_{41}N(R_{43})-$, $R_{43}-N(R_{44})-CO-N(R_{45})-$, or $R_{41}SO_2N(R_{43})-$.

$R_{58}$ has the same significance as $R_{41}$. $R_{59}$ has the same significance as $R_{41}$, $R_{41}CON(R_{43})-$, $R_{41}OCON(R_{43})-$, $R_{41}SO_2N(R_{43})-$, $R_{43}N(R_{44})-CO-N(R_{45})-$, $R_{43}-N(R_{44})-SO_2-N(R_{45})-$, $R_{41}O-$, $R_{41}S-$, a halogen atom, or $R_{41}N(R_{43})-$.

In formulae (Cp-6) and (Cp-7), d represents an integer of from 0 to 3. When d is 2 or 3, plural $R_{59}$s may be the same or different. In this case, also, these $R_{59}$s may combine with each other as divalent groups to form a cyclic structure. Examples of the divalent groups for forming a cyclic structure are

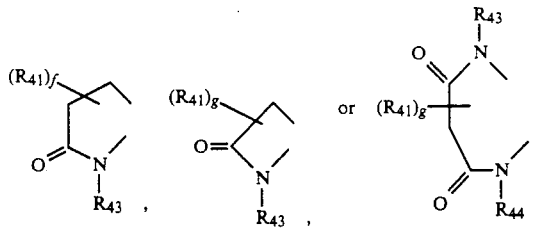

where f represents an integer of from 0 to 4, and g represents an integer of from 0 to 2.

In formula (Cp-7), $R_{60}$ has the same significance as $R_{41}$. In formula (Cp-8), $R_{61}$ has the same significance as $R_{41}$, and $R_{62}$ represents the same group as $R_{41}$, $R_{41}CONH-$, $R_{41}OCONH-$, $R_{41}SO_2NH-$, $R_{43}-N(R_{44})-CO-N(R_{45})-$, $R_{43}-N(R_{44})-SO_2-N(R_{45})-$, $R_{43}O-$, $R_{41}S-$, a halogen atom or $R_{41}N(R_{43})-$.

In formula (Cp-9), $R_{63}$ represents the same group as $R_{41}$, $R_{43}CON(R_{44})-$, $R_{43}NCO(R_{44})-$, $R_{41}SO_2N(R_{44})-$, $R_{43}NSO_2(R_{44})-$, $R_{41}SO_2-$, $R_{43}OCO-$, $R_{43}OSO_2-$, a halogen atom, a nitro group, a cyano group, or $R_{43}CO-$.

In formulae (Cp-8) and (Cp-9), e represents an integer of from 0 to 4. When e is 2 or more, plural $R_{62}$s or $R_{63}$s may be the same or different.

In the aforesaid formulae, the aliphatic group is a saturated or unsaturated, chain, cyclic, straight chain or branched, substituted or unsubstituted aliphatic hydrocarbon group having from 1 to 32, and preferably from 1 to 22 carbon atoms. As the substituent for the aliphatic hydrocarbon group, there are an alkyl group, an aryl group or a heterocyclic residue. Typical examples of the aliphatic group are methyl, ethyl, propyl, isopropyl, butyl, (t)-butyl, (i)-butyl, (t)-amyl, hexyl, cyclohexyl, 2-ethylhexyl, octyl, 1,1,3,3-tetramethylbutyl, decyl, dodecyl, hexadecyl and octadecyl.

In the aforesaid formulae, the aromatic group has from 6 to 20 carbon atoms and is preferably a substituted or unsubstituted phenyl group or a substituted or unsubstituted naphthyl group.

In the aforesaid formulae, the heterocyclic group has from 1 to 20, and preferably from 1 to 7 carbon atoms and is preferably a 3- to 8-membered substituted or unsubstituted heterocyclic group having nitrogen, oxygen or sulfur as a hetero atom. Typical examples of the heterocyclic group are 2-pyridyl, 4-pyridyl, 2-thienyl, 2-furyl, 2-imidazolyl, pyradinyl, 2-pyrimidinyl, 1-imidazolyl, 1-indolyl, 1,3,4-thiadiazol-2-yl, benzoxazol-2-yl, 2-quinolyl, 2,4-dioxo-1,3-imidazolidin-5-yl, 2,4-dioxo-1,3-imidazolidin-3-yl, succinimido, phthalimido, 1,2,4-triazol-2-yl and 1-pyrazolyl.

The aforesaid aliphatic hydrocarbon group, aromatic group, and heterocyclic group each may have substituent(s) and typical examples of the substituent are a halogen atom, $R_{47}O-$, $R_{46}S-$, $R_{47}CON(R_{48})-$, $R_{47}NCO(R_{48})-$, $R_{46}OCON(R_{47})-$, $R_{46}SO_2N(R_{47})-$, $R_{47}NSO_2(R_{48})-$, $R_{46}SO_2-$, $R_{47}OCO-$, $R_{47}-N(R_{48})-CO-N(R_{49})-$, the same group as $R_{46}$,

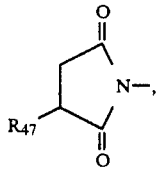

a cyano group, or a nitro group, where $R_{46}$ represents an aliphatic group, an aromatic group or a heterocyclic group, and $R_{47}$, $R_{48}$ and $R_{49}$ each represents an aliphatic group, an aromatic group, a heterocyclic group or a hydrogen atom. The aliphatic group, the aromatic group and the heterocyclic group have the same significance as defined above for (Cp-6) to (Cp-9).

Preferred examples of $R_{51}$ to $R_{63}$, d and e are now explained.

$R_{51}$ is preferably an aliphatic group or an aromatic group.

$R_{52}$, $R_{53}$ and $R_{55}$ are preferably an aromatic group.

$R_{54}$ is preferably $R_{41}CONH-$ or $R_{41}-N(R_{43})-$.

$R_{56}$ and $R_{57}$ are preferably an aliphatic group, $R_{41}O-$ or $R_{41}S-$.

$R_{58}$ is preferably an aliphatic group or an aromatic group.

In formula (Cp-6), $R_{59}$ is preferably a chlorine atom, an aliphatic group or $R_{41}CONH-$.

$R_{60}$ is preferably an aromatic group and d is preferably 1 or 2.

In formula (Cp-7), $R_{59}$ is preferably $R_{41}CONH-$ and d is preferably 1. $R_{61}$ is preferably an aliphatic group or an aromatic group.

In formula (Cp-8), e is preferably 0 or 1, $R_{62}$ is preferably $R_{41}OCONH-$, $R_{41}CONH-$, or $R_{41}SO_2NH-$, and the group is preferably at the 5-position of the naphthol ring.

In formula (Cp-9), $R_{63}$ is preferably $R_{41}SO_2NH-$, $R_{41}NSO_2(R_{43})-$, $R_{41}SO_2-$, $R_{41}NCO(R_{43})-$, a nitro group or a cyano group.

Typical examples of $R_{51}$ to $R_{63}$ are now given.

$R_{51}$: (t)-butyl, 4-methoxyphenyl, phenyl, 3-[2-(2,4-di-t-amylphenoxy)butanamido]phenyl, 4-octadecyloxyphenyl, and methyl.

$R_{52}$ and $R_{53}$: 2-chloro-5-dodecyloxycarbonylphenyl, 2-chloro-5-hexadecylsulfonamidophenyl, 2-chloro5-tetradecanamidophenyl, 2-chloro-5-[4-(2,4-di-tamylphenoxy)butanamido]phenyl, 2-chloro-5-[2-(2,4-di-tamylphenoxy)butanamido]phenyl, 2-methoxyphenyl, 2-methoxy-5-tetradecyloxycarbonylphenyl, 2-chloro-5(1-ethoxycarbonylethoxycarbonyl)phenyl, 2-pyridyl, 2-chloro-5-octyloxycarbonylphenyl, 2,4-dichlorophenyl, 2-chloro-5-(1-dodecyloxycarbonylethoxycarbonyl)phenyl, 2-chlorophenyl, and 2-ethoxyphenyl.

$R_{54}$: 3-[2-(2,4-di-t-amylphenoxy)butanamido]benzamido, 3-[4-(2,4-di-t-amylphenoxy)butanamido]benzamido, 2-chloro-5-tetradecanamidoanilino, 5-(2,4-di-t-amylphenoxyacetamido)benzamido, 2-chloro-5-dodecenylsuccinimidoanilino, 2-chloro-5-[2-(3-t-butyl-4-hydroxyphenoxy)tetradecanamido]anilino, 2,2-dimethylpropanamido, 2-(3-pentadecylphenoxy)-butanamido, pyrrolidino, and N,N-dibutylamino.

$R_{55}$: 2,4,6-trichlorophenyl, 2-chlorophenyl, 2,5-dichlorophenyl, 2,3-dichlorophenyl, 2,6-dichloro-4-methoxyphenyl, 4-[2-(2,4-di-t-amylphenoxy)-butanamido]phenyl and 2,6-dichloro-4-methanesulfonylphenyl.

$R_{56}$: methyl, ethyl, isopropyl, methoxy, ethoxy, methylthio, ethylthio, 3-phenylureido, 3-butylureido, and 3-(2,4-di-t-amylphenoxy)propyl.

$R_{57}$: 3-(2,4-di-t-amylphenoxy)propyl, 3-[4-{2[4-(4-hydroxyphenylsulfonyl)phenoxy]tetradecanamido}phenyl]propyl, methoxy, ethoxy, methylthio, ethylthio, methyl, 1-methyl-2-{2-octyloxy-5-[2-octyloxy-5-(1,1,3,3-tetramethylbutyl)phenylsulfonamido]phenylsulfonamido}ethyl, 3-[4-(4-dodecyloxyphenylsulfonamido)phenyl]propyl, 1,1-dimethyl-2-[2-octyloxy-5-(1,1,3,3-tetramethylbutyl)phenylsulfonamido]ethyl, and dodecylthio.

$R_{58}$: 2-chlorophenyl, pentafluorophenyl, heptafluoropropyl, 1-(2,4-di-t-amylphenoxy)propyl, 3-(2,4-di-t-amylphenoxy)propyl, 2,4-di-t-amylmethyl, and furyl.

$R_{59}$: chlorine, methyl, ethyl, propyl, butyl, isopropyl, 2-(2,4-di-t-amylphenoxy)butanamido, 2-(2,4-di-t-amylphenoxy)hexanamido, 2-(2,4-di-t-octylphenoxy)octanamido, 2-(2-chlorophenoxy)tetradecanamido, 2,2dimethylpropanamido, 2-[4-(4-hydroxyphenylsulfonyl)phenoxy]tetradecanamido, and 2-[2-(2,4-di-t-amylphenoxyacetamido)phenoxy]butanamido.

$R_{60}$: 4-cyanophenyl, 2-cyanophenyl, 4-butylsulfonylphenyl, 4-propylsulfonylphenyl, 4-ethoxycarbonylphenyl, 4-N,N-diethylsulfamoylphenyl, 3,4-dichlorophenyl, and 3-methoxycarbonylphenyl.

$R_{61}$: dodecyl, hexadecyl, cyclohexyl, butyl, 3-(2,4-di-t-amylphenoxy)propyl, 4-(2,4-di-t-amylphenoxy)butyl, 3-dodecyloxypropyl, 2-tetradecyloxyphenyl, t-butyl, 2-(2-hexyldecyloxy)phenyl, 2-methoxy-5dodecyloxycarbonylphenyl, 2-butoxyphenyl, and 1-naphthyl.

$R_{62}$: isobutyloxycarbonylamino, ethoxycarbonylamino, phenylsulfonylamino, methanesulfonamido, butanesulfonamido, 4-methylbenzenesulfonamido, benzamido, trifluoroacetamido, 3-phenylureido, butoxycarbonylamino, and acetamido.

$R_{63}$: 2,4-di-t-amylphenoxyacetamido, 2-(2,4-di-t-amylphenoxy)butanamido, hexadecylsulfonamido, N-methyl-N-octadecylsulfamoyl, N,N-dioctylsulfamoyl, dodecyloxycarbonyl, chlorine, fluorine, nitro, cyano, N-3-(2,4-di-t-amylphenoxy)propylsulfamoyl, methanesulfonyl, and hexadecylsulfonyl.

In formula (III) described above, as the timing group shown by ($Time_2$), there are exemplified the following linkage groups:

(1) Groups utilizing the cleavage reaction of hemiacetal:

The linkage groups are, for example, the groups shown by the following formula (T-1) as described in U.S. Pat. No. 4,146,396 and JP-A-60-249148 and 60-249149, wherein * shows the position of bonding to $A_3$ in formula (III) and ** shows the position of bonding to Y in formula (III).

(T-1)

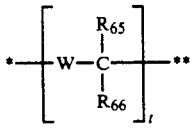

wherein W represents an oxygen atom, a sulfur atom, or

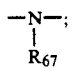

$R_{65}$ and $R_{66}$ each represents a hydrogen atom or a substituent; $R_{67}$ represents a substituent; and t represents 1 or 2. When t is 2, two

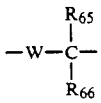

may be the same or different.

When $R_{65}$ and $R_{66}$ represent a substituent, typical examples of the substituent and typical examples of the substituent shown b $R_{67}$ are $R_{69}$, $R_{69}CO$—, $R_{69}SO_2$—,

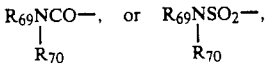

wherein $R_{69}$ represents an aliphatic group (preferably alkyl having from 1 to 20 carbon atoms), an aromatic group (preferably aryl having from 6 to 20 carbon atoms), or a heterocyclic group (preferably having from 1 to 20 carbon atoms) and $R_{70}$ represents a hydrogen atom, an aliphatic group, an aromatic group, or a heterocyclic group, and each group has the same significance as those represented by $R_{69}$.

$R_{65}$, $R_{66}$ and $R_{67}$ in formula (T-1) may also combine with each other as divalent groups to form a cyclic structure. As preferred examples of the cyclic structure, these are 5-, 6- and 7-membered carbon rings and 5-, 6- and 7-membered heterocyclic groups.

Examples of the group shown by formula (T-1) are now illustrated.

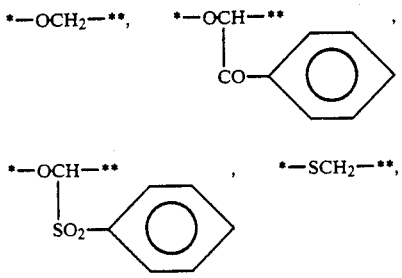

-continued

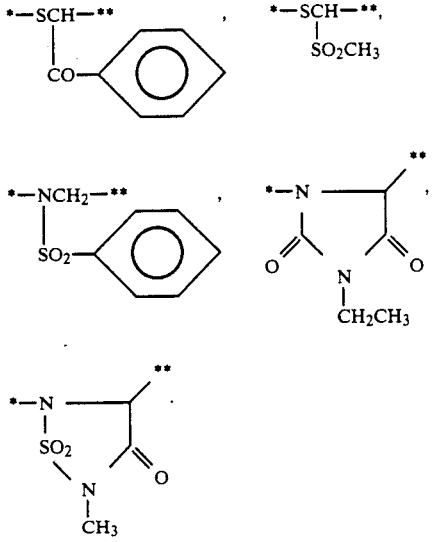

(2) Groups causing a cleavage reaction by utilizing an intramolecular nucleophilic reaction:

For example, there are the timing groups described in U.S. Pat. No. 4,248,962 and they can be shown by the following formula (T-2):

*-Nu-Link-E-** (T-2)

wherein * shows the position of bonding to $A_3$ in formula (III) and ** shows the position of bonding to Y in formula (III).

In formula (T-2), Nu represents nucleophilic group, examples of the nucleophilic nucleus being an oxygen atom and a sulfur atom; E represents an electrophilic group which can cleave the bond to ** by receiving the nucleophilic attack of Nu; and Link represents a linkage group sterically connecting Nu and E so that they can cause an intramolecular nucleophilic substitution reaction.

Examples of the group shown by formula (T-2) are now illustrated.

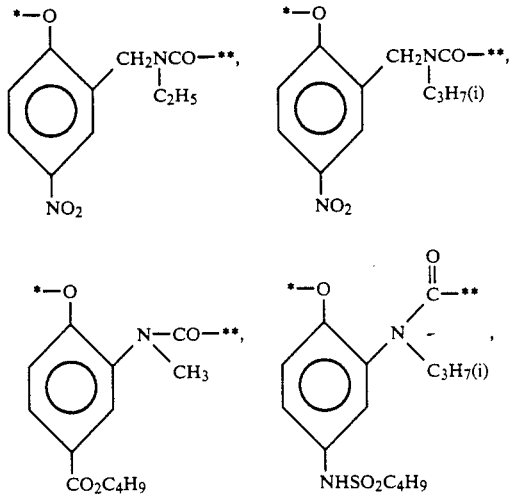

-continued

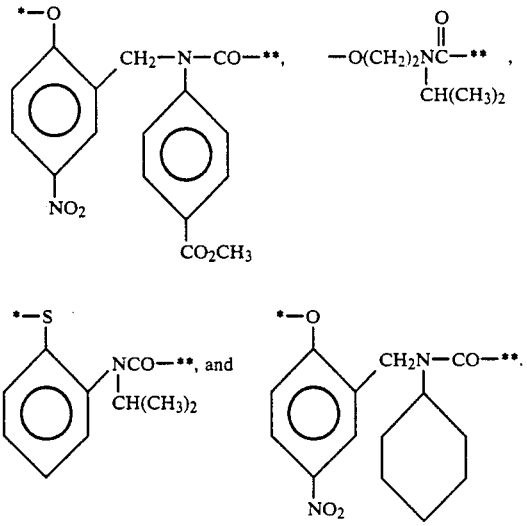

(3) Groups causing a cleavage reacting by utilizing an electron transfer reaction based on a conjugated system:

As example, there are the groups described in U.S. Pat. Nos. 4,409,323 and 4,421,845, which are shown by the following formula (T-3):

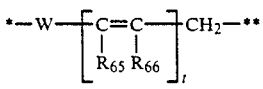

(T-3)

wherein *, **, W, $R_{65}$, $R_{66}$ and t have the same significance as defined for formula (T-1).

Examples of the group shown by formula (T-3) are as follows.

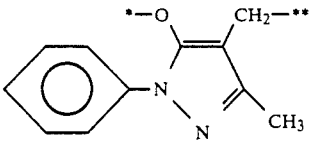

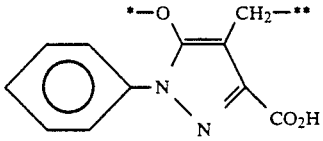

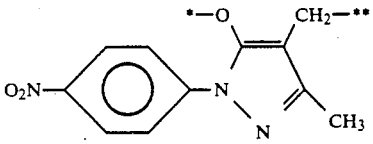

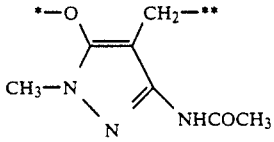

-continued

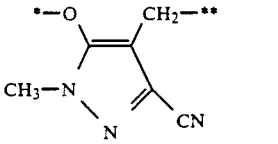

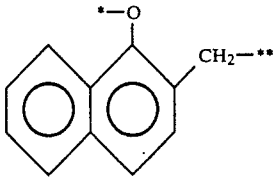

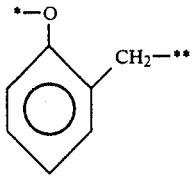

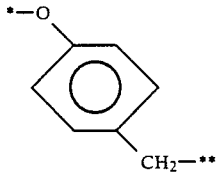

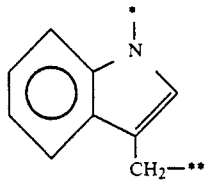

(4) Groups of utilizing a cleavage reaction by the hydrolysis of ester:

For example, there are the linkage groups described in West German Patent Application (OLS) 2,626,315 as shown below, wherein * and ** have the same significance as explained for formula (T-1):

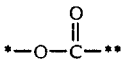

(T-4)

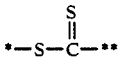

(T-5)

(5) Groups of utilizing a cleavage reaction of iminoketal:

For example, there are the linkage groups described in U.S. Pat. No. 4,546,073, which are shown by the following formula (T-6):

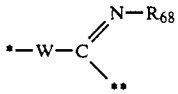

(T-6)

wherein * and ** have the same significance as explained for formula (T-1) and $R_{68}$ has the same significance as defined for $R_{67}$ in formula (T-1).

Examples of the group shown by formula (T-6) are now illustrated.

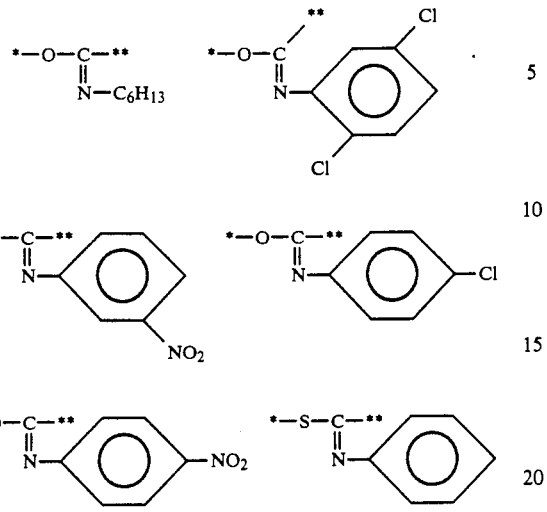

In the compounds of formula (I), the light-collecting dyes shown by $A_1$ can be easily synthesized by the method described, for example, in F. M. Hamer, *Heterocyclic Compounds—The Cyanine Dyes and Related Compounds*, John Wiley & Sons (1964).

The compounds of formula (I) can be easily synthesized by known methods such as, for example, the synthesis method described in JP-A-59-201057 and 61-43739.

The compounds of formula (II) described above can be synthesized by the following two kinds of methods.

When ($Time_1$) is a simple bonding hand ($t_1=0$), in the first method a benzoquinone derivative, an orthoquinone derivative, a quinonemonoimine derivative or a quinonediimine derivative is reacted with a light-collecting dye in a solvent such as chloroform, 1,2-dichloroethane, carbon tetrachloride, or tetrahydrofuran in the absence of catalyst or in the presence of an acid catalyst such as p-toluenesulfonic acid, benzenesulfonic acid, trifluoromethanesulfonic acid, methanesulfonic acid, etc., at a temperature of from room temperature to 100° C., or, in the second method, a benzoquinone derivative, an orthoquinone derivative, a quinonemonoimine derivative, or a quinonediimine derivative each substituted by chlorine, bromine or iodine is reacted with a light-collecting dye in an anti-protonic polar solvent such as acetone, tetrahydrofuran, dimethylformamide, etc., in the presence of a base such as potassium carbonate, sodium hydrogencarbonate, sodium hydride, triethylamine, etc., at a temperature of from −20° C. to 100° C. to provide a quinone product and then the quinone product obtained is reduced by a reducing agent such as diethylhydroxylamine, sodium hydrosulfite, etc. (Reference Literature: *Research Disclosure*, No. 18227 (1979) and Liebigs, *Ann. Chem.*, 764, 131 (1972))

Examples for the quinone derivative above are as follows.

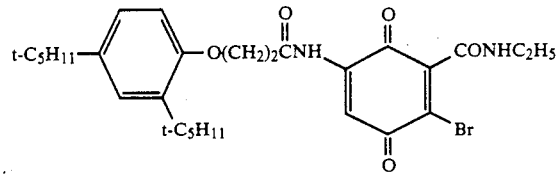

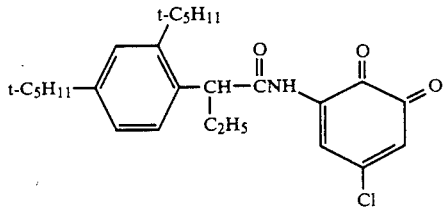

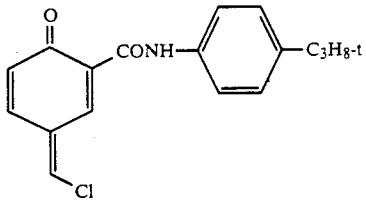

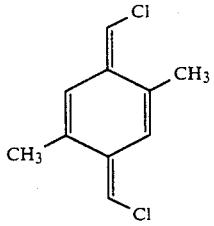

In the case that $A_2$ is released through ($Time_1$) ($t_1=1$), the compound of formula (II) can be synthesized by essentially the same method as described above. That is, $Time_1$-$A_1$ is used in place of the light-collecting dye ($A_1$) in the aforesaid methods or after introducing ($Time_1$) having a group which can be substituted with $A_1$ (e.g., halogen atom, a hydroxy group or a precursor thereof) into a redox mother nucleus, $A_1$ is bonded thereto by a substitution reaction.

The compounds of formula (III) can be easily synthesized by known methods, such as the synthesis methods described in JP-A-60-249148 and 60-249149, U.S. Pat. Nos. 4,146,396, 4,248,962, 4,409,323, 4,421,845 and 4,546,073, and West German Patent Application (OLS) 2,626,315.

The compounds for use in this invention shown by formula (I), (II) and (III) are illustrated below without limitation of this invention.

(1)
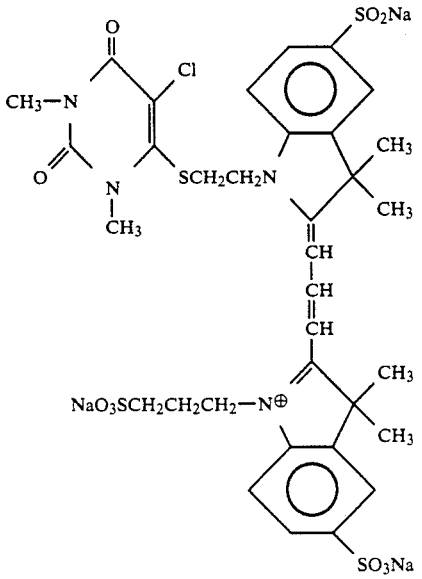
(2)
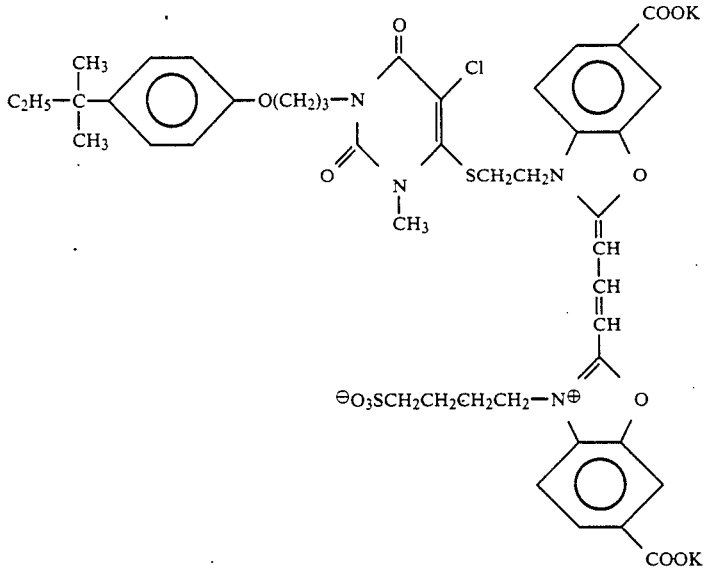
(3)
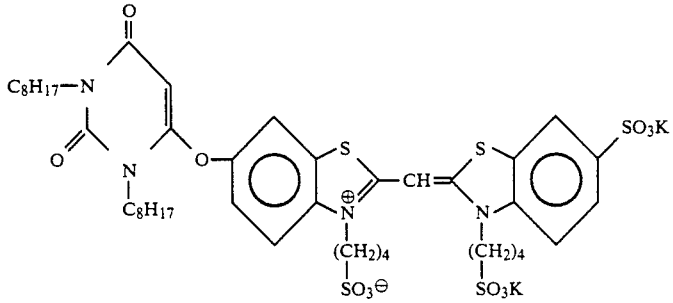

-continued
(4)
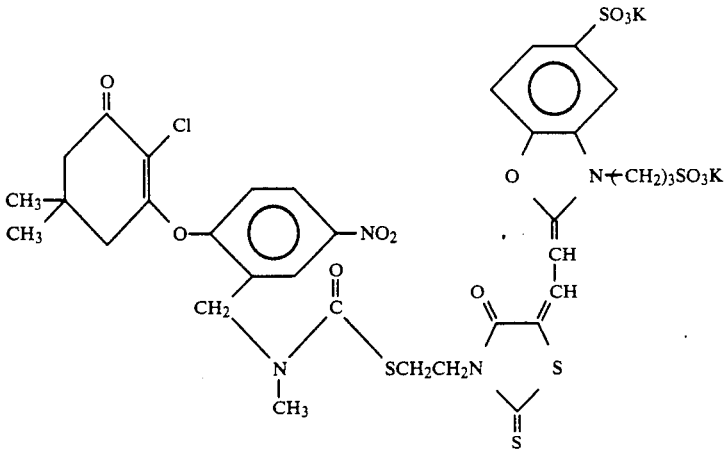
(5)
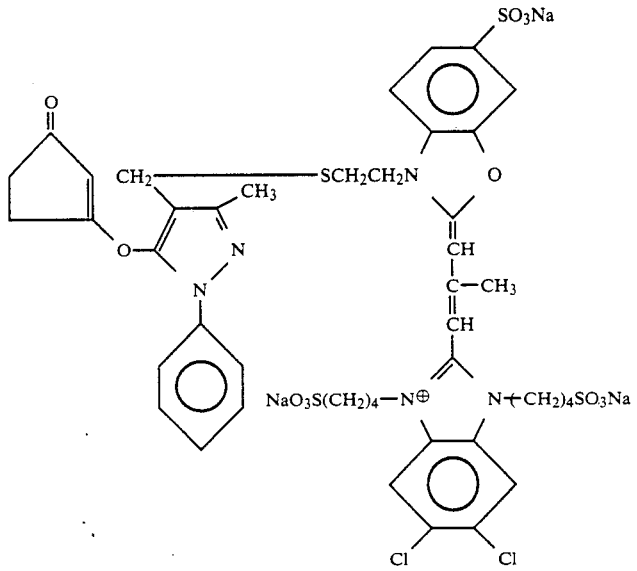
(6)
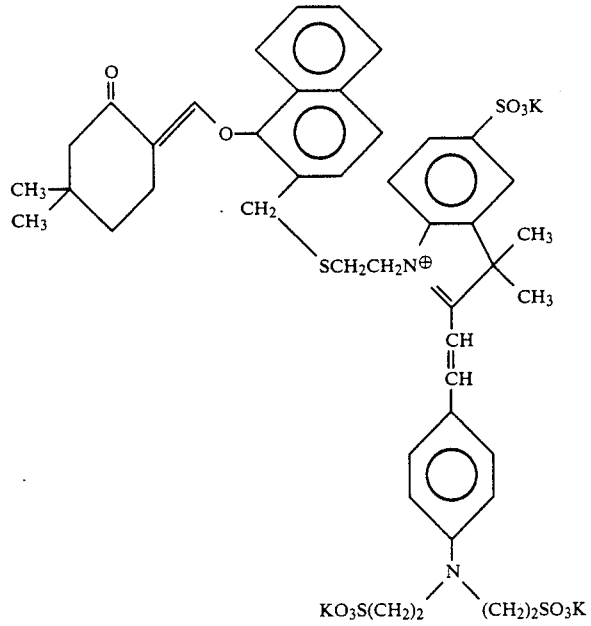

-continued
(7)
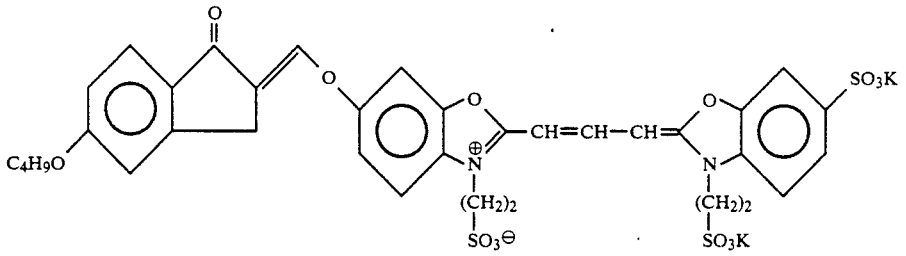
(8)
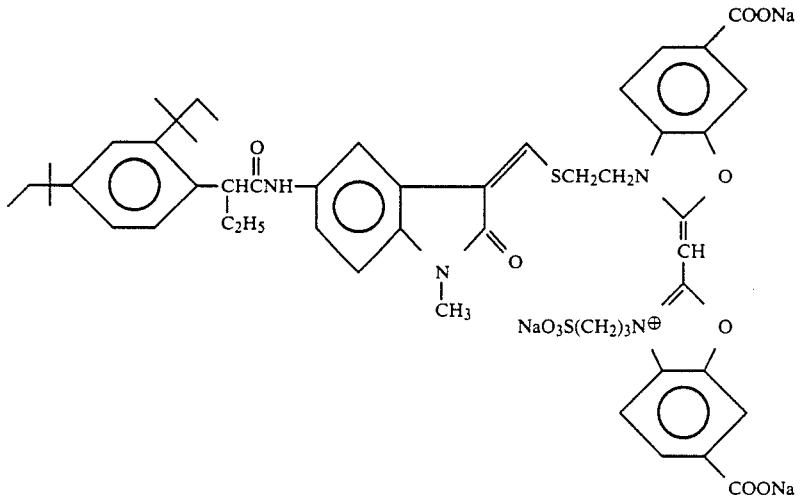
(9)
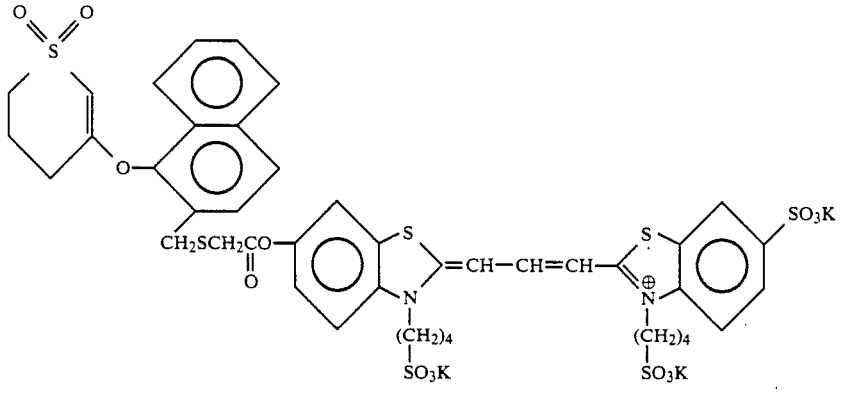
(10)
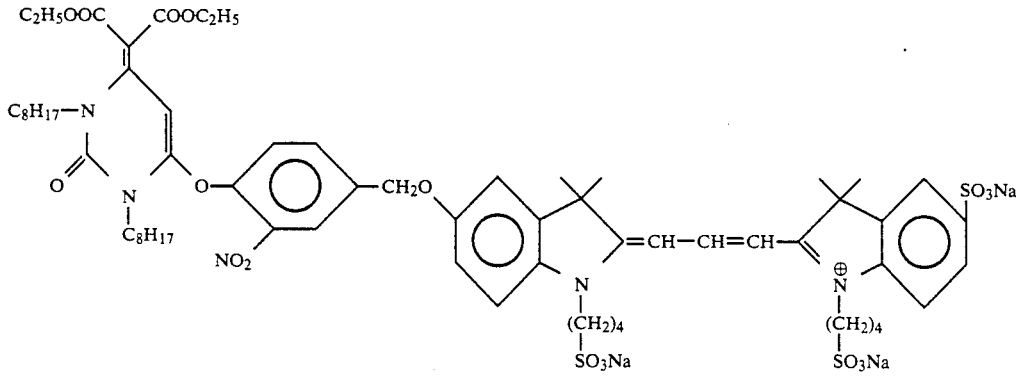

-continued
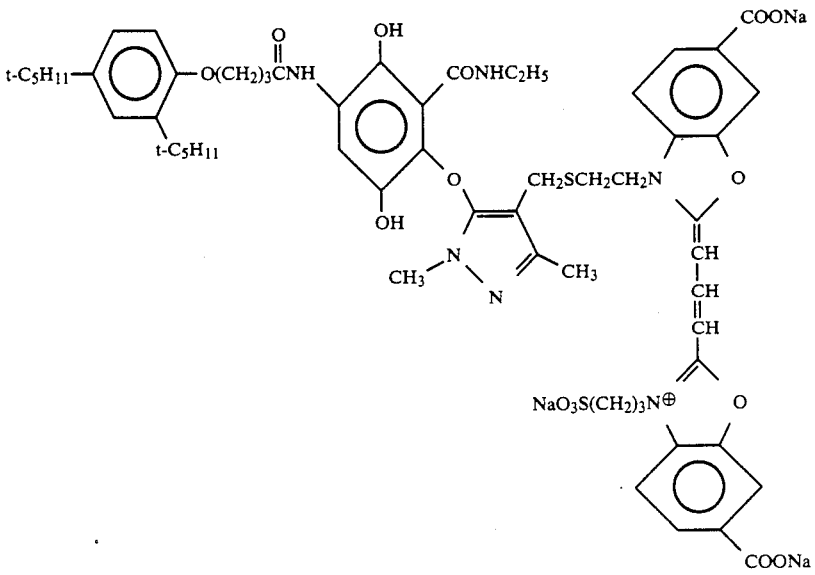
(11)
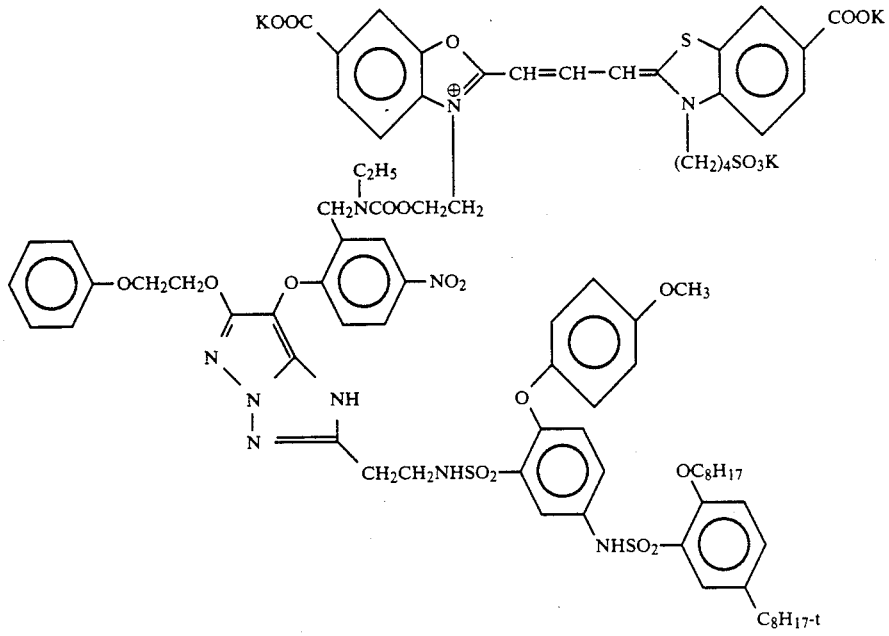
(12)

-continued (13)

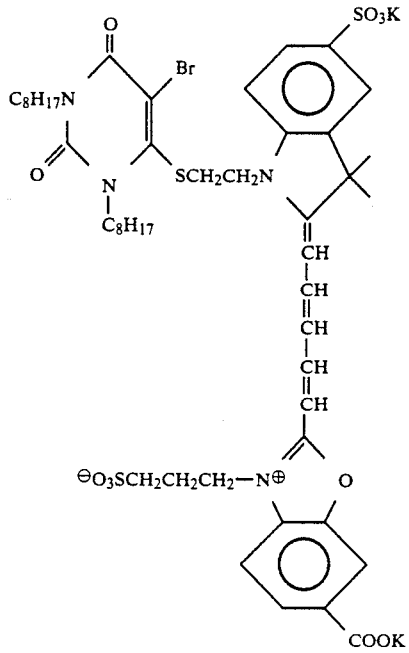

(14)

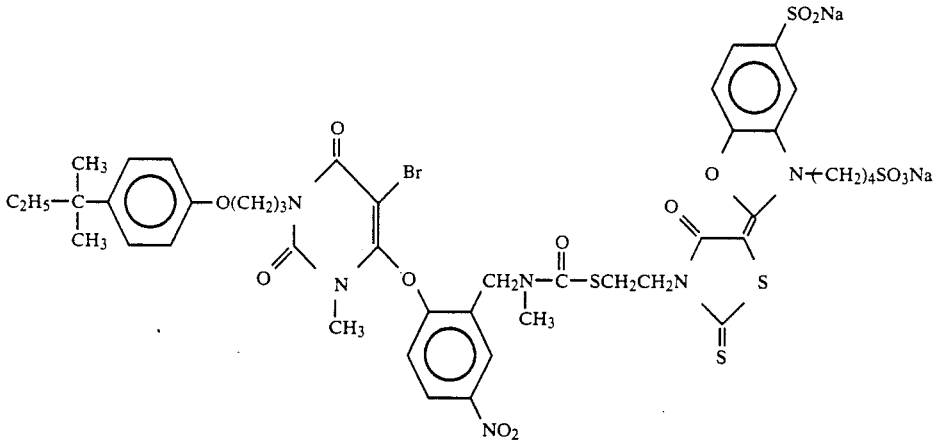

In the case of incorporating compounds of formula (I), (II) or (III) in a silver halide emulsion, the compound(s) is used in an amount of from $5\times10^{-7}$ to $1\times10^{-2}$ mol, and preferably from $5\times10^{-6}$ to $2\times10^{-3}$ mol, per mol of silver halide. The optimum amount of the compound depends upon the chemical structure of the compound and the crystal habit and grain size of the silver halide emulsion. Also, the compound may be added to the silver halide emulsion at any step such as mixing the raw materials for the emulsion, preripening, postripening, etc., and/or may be added to a coating composition for the emulsion layer prepared directly before coating.

In the case of incorporating compounds of formula (I), (II) or (III) in a hydrophilic colloid layer adjacent to the emulsion layer, the compounds are used in an amount of from $1\times10^{-5}$ to $2\times10^{-3}$ mol per mol of silver halide in the emulsion layer.

The compounds of formula formula (I), (II) or (III) can be directly added to a silver halide emulsion or a hydrophilic colloid solution. Also, the compound may be added to an emulsion as a solution thereof in a solvent such as methanol, ethanol, propanol, methyl cellosolve, the halogenated alcohols described in JP-A-48-9715 and U.S. Pat. No. 3,756,830, acetone, water, pyridine, etc., or a mixture thereof.

As other addition method for the compound, the methods described in JP-B-46-24185 and 61-45217 (the term "JP-B" as used herein refers to an "examined published Japanese patent publication"), and U.S. Pat. Nos. 3,822,135, 3,660,101, 2,912,343, 2,996,287, 3,429,835, 3,649,286 and 3,658,546 and West German Patent Application (OLS) 2,104,283 can be used. Also, the compound may be added as solid powder or a suspension of an insoluble dye suspended in a solution as described in JP-A-61-196749. In this case, if necessary, a binder as well as additives such as a pH controlling agent, a surface active agent, etc., may be added to the solution or the suspension of the compound.

The silver halide emulsion for use in this invention may contain silver bromide, silver iodobromide, silver iodochlorobromide, silver chlorobromide or silver chloride.

The silver halide grains in the photographic emulsion for use in this invention may have a regular crystal form such as cubic, octahedral, etc., an irregular crystal form such as spherical, tabular, etc., or a composite form of these crystal forms. Also, the silver halide grains may be composed of a mixture of silver halide grains having various crystal forms.

The silver halide grains for use in this invention may have different phases between the inside and the surface layer thereof or may have a uniform phase throughout the whole grain. Also, the silver halide emulsion for use in this invention may be the type forming latent images mainly on the surface thereof (e.g., a negative working type emulsion) or the type forming latent images mainly in the inside of the grain (e.g., an internal latent image type emulsion and a previously fogged direct reversal type emulsion).

The silver halide grains of the silver halide emulsion for use in this invention may be tabular grains where the grains have a thickness of less than 0.5 μm, and preferably less than 0.3 μm, a diameter of less than 0.6 μm, a mean aspect ratio of at least 5 and account for at least 50% of the total projected area of the silver halide grains.

Also, the silver halide emulsion for use in this invention may be a monodispersed emulsion where silver halide grains having grain sizes within ±40% of the mean grain size account for at least 95% of the number of the total grains.

The compound shown by formula (I), (II) or (III) for use in this invention may be used alone but may also be used as a combination with a spectral sensitizing dye which is conventionally used for the spectral sensitization of silver halide emulsions. Spectral sensitizing dyes are frequently used as a combination of two or more kinds thereof for super (color) sensitization.

Also, a dye having no spectral sensitizing action by itself or a material which does not substantially absorb visible light but shows super (color) sensitization may be used for the silver halide emulsion together with the invention sensitizing dye(s). For example, there are aminostilbene compounds substituted by a nitrogen-containing heterocyclic group (e.g., those described in U.S. Pat. Nos. 2,933,390 and 3,635,721), aromatic organic formaldehyde condensates (e.g., those described in U.S. Pat. No. 3,743,510), cadmium salts, and azaindene compounds.

When a spectral sensitizing dye is used as a sensitizing dye, the silver halide emulsion can be a conventional surface latent image type negative working emulsion or an internal latent image type direct positive emulsion. In other embodiments, the silver halide emulsion is a positive working emulsion of the type providing positive images by the rupture of surface fogged nuclei under light exposure, where a spectral sensitizing dye is used as an electron accepting type dye. Furthermore, according to the purpose of the light-sensitive material, an adsorptive super (color) sensitizer and various additives (antifoggants, etc.) may be used with the adsorptive dye for the purpose of spectrally sensitizing the emulsion to the optimum level.

The silver halide emulsion may be used as a primitive emulsion without being chemically sensitized but is usually chemically sensitized by a conventional method such as, for example, the method described in H. Frieser, *Die Grundlagen der Photographischen Prozesse mit Silberhalogeniden*, pages 675 to 734, Akademische Verlagsgesellschaft. That is, a sulfur sensitizing method using active gelatin or a sulfur-containing compound capable of reacting with silver (e.g., thiosulfates, thioureas, mercapto compounds, rhodanines, etc.), a reduction sensitizing method using a reducing agent (e.g., stannous salts, amines, hydrazine derivatives, formamidine sulfinic acid, silane compounds, etc.), and a noble metal sensitizing method using a noble metal compound (e.g., gold complexes as well as complex salts of other noble metals belonging to group VIII of the Periodic Table, such as Pt, Ir, Pd, etc.) can be used solely or as a combination thereof.

For the silver halide photographic emulsions for use in this invention, various kinds of compounds can be used for the purpose of preventing the formation of fog during production, storage and photographic processing of the photographic light-sensitive materials of this invention or stabilizing the photographic performance thereof.

Examples of such compounds are those known as antifoggants or stabilizers, for example, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.; mercaptopyrimidines; mercaptotriazines; thioketo compounds such as oxazolinethione; azaindenes such as triazaindenes, tetraazaindenes (in particular, 4-hydroxy-substituted (1,3,3*a*,7)tetraazaindenes), pentaazaindenes, etc.; benzenethiosulfonic acid; benzenesulfinic acid, and benzenesulfonic acid amide.

Also, for the silver halide photographic emulsions for use in this invention there may be used polyalkylene oxides or derivatives thereof, such as ethers, esters, amines, etc., thioether compounds, thiomorpholines, quaternary ammonium salt compounds, urethane derivatives, urea derivatives, imidazole derivatives, 3-pyrazolidones, etc., for the purpose of increasing sensitivity, increasing contrast, or development acceleration.

In the case of applying the present invention to color photographic materials, various kinds of color couplers can be used. A color coupler is a compound capable of forming a dye by causing a coupling reaction with the oxidation product of an aromatic primary amine developing agent. Typical examples of the color couplers are naphthol or phenol series couplers, pyrazolone or pyrazoloazole series compounds, and open chain or heterocyclic ketomethylene compounds. Practical examples of these cyan, magenta, and yellow coloring couplers are described in *Research Disclosure* (*RD*), No. 17643 (December, 1978), ibid., No. 18717 (November, 1979), and the patents cited therein.

The various kinds of couplers for use in this invention can be used in one light-sensitive emulsion layer as a combination of two or more or the same type of coupler may be introduced into two or more different emulsion layers to meet the characteristics required for the photographic light-sensitive material.

The invention can be applied to a multilayer multicolor photographic material having at least two emulsion layers having different spectral sensitivities on a support.

A multilayer natural color photographic material usually has at least one red-sensitive emulsion layer, at least one green-sensitive emulsion layer, and at least one blue-sensitive emulsion layer on a support. The order of these emulsion layers can be optionally selected according to requirements. Usually, the red-sensitive emulsion layer contains a cyan-forming coupler, the green-sensitive emulsion layer a magenta-forming coupler, and the blue-sensitive emulsion layer a yellow-forming coupler, but as the case may be, other combinations can be selected.

For correcting the undesired absorptions of the dyes formed from magenta and cyan couplers, it is preferred to use colored couplers in the case of a negative color photographic material for camera use. Examples of such colored couplers are yellow-colored magenta couplers as described in U.S. Pat. No. 4,163,670 and JP-B-57-39413 and magenta-colored cyan couplers as described in U.S. Pat. Nos. 4,004,929 and 4,138,258 and British Patent 1,146,368.

In this invention, couplers giving a colored dye having proper diffusibility can be used for improving the graininess of the silver halide emulsions together with the aforesaid color couplers. As such couplers, there are magenta couplers as described in U.S. Pat. No. 4,336,237 and British Patent 2,125,570 and yellow, magenta and cyan couplers as described in European Patent 96,570 and West German Patent Application (OLS) 3,234,533.

The dye-forming couplers and aforesaid specific couplers may form a dimer or higher polymer. Typical examples of polymerized dye-forming couplers are described in U.S. Pat. Nos. 3,451,820 and 4,080,211. Also, specific examples of polymerized magenta couplers are described in British Patent 2,102,173, U.S. Pat. No. 4,367,282, JP-A-61-232455 and 62-54260.

A coupler releasing a photographically useful group upon coupling can also be preferably used in this invention. As a DIR coupler releasing a development inhibitor as the photographically useful group, the couplers described in the patents cited in *Research Disclosure*, No. 17643, VII-F are useful.

For the photographic light-sensitive materials of this invention there can be used couplers imagewise releasing a nucleating agent or a development accelerator, or a precursor thereof, at development. Examples of such couplers are described in British Patents 2,097,140 and 2,131,188. Furthermore, couplers releasing a nucleating agent having an adsorptive action for silver halide can be preferably used in this invention and examples thereof are described in JP-A-59-157638 and 59-170840.

The photographic light-sensitive material of this invention may contain an inorganic or organic hardening agent in the silver halide emulsion layer and any other optional hydrophilic colloid layers. Examples of the hardening agents are chromium salts, aldehydes (formaldehyde, glyoxal, glutaraldehyde, etc.), N-methylol compounds (dimethylolurea, etc.). Also, active halogen compounds (2,4-dichloro-6-hydroxy-1,3,5-triazine, etc.) and active vinyl compounds (1,3-bisvinylsulfonyl-2-propanol, 1,2-bisvinylsulfonylacetamidoethane, vinylic polymers having vinylsulfonyl at the side chain, etc.) are preferred since they quickly harden hydrophilic colloids such as gelatin and give stable photographic characteristics. Furthermore, N-carbamoylpyridinium salts and haloamizinium salts are excellent in high speed of hardening.

For the silver halide emulsions for use in this invention there can be used various kinds of additives. That is, surface active agents, tackifiers, dyes, ultraviolet absorbents, antistatic agents, whitening agents, desensitizers, developing agents, fading inhibitors, mordants, etc., can be used.

The additives are described in *Research Disclosure*, 17643, No. 176, 22–31 (December, 1978), T. H. James, *The Theory of the Photographic Process*, (4th Ed.), Macmillan Publishers Co., Inc., 1977, etc.

For preparing the photographic light-sensitive material of this invention, photographic emulsion layers and other layers are formed on a flexible support such as a plastic film, a paper, a cloth, etc., usually used for photographic light-sensitive materials, or a solid support such as glass, ceramics, metals, etc. Examples of useful flexible support are films of a semisynthetic or synthetic polymer such as cellulose nitrate, cellulose acetate, cellulose acetate butyrate, polystyrene, polyvinyl chloride, polyethylene terephthalate, polycarbonate, etc., and papers coated or laminated with a baryta layer or an α-olefin polymer (e.g., polyethylene, polypropylene, and ethylene-butene copolymers).

The support may be, if necessary, colored by using dyes or pigments. The support may be colored black for the purpose of light shielding.

The surface of the support is generally subjected to a subbing treatment for improving the adhesive property for a photographic emulsion layer, etc. The surface of the support may be subjected to a glow discharge, corona discharge, ultraviolet irradiation, flame treatment, etc., before or after the subbing treatment.

The light exposure for obtaining photographic images in this invention may be performed by using a conventional method. That is, various light sources such as natural light (sunlight), a tungsten lamp, a fluorescent lamp, a mercury lamp, a xenon arc lamp, a carbon arc lamp, a xenon flash lamp, a cathode ray tube, a flying spot, etc., can be used. The exposure time is as a matter of course from 1/1,000 second to 1 second, which is usually used for cameras, as well as from $1/10^4$ to $1/10^9$ second in the case of using a xenon flash lamp, a cathode ray tube or a laser light or may be longer than 1 second. If necessary, the spectral composition of the light used for the light exposure can be controlled by a color filter. Also, light emitted from phosphor excited by electron rays, X-rays, γ-rays, α-rays, etc., can be used as the light source.

For photographic processing of the photographic light-sensitive materials of this invention, known processes and known processing solutions are described in *Research Disclosure*, 17643, No. 176, pages 28 to 30 can be applied. The photographic processing may be photographic processing for forming silver images (black-and-white photographic processing) or photographic processing for forming dye images (color photographic processing), according to the purpose. The processing temperature is usually selected from 18° C. to 50° C. but may be lower than 18° C. or higher than 50° C., as the case may be.

As a specific system for development, one process can be carrying out the development of the photographic light-sensitive material containing a developing agent in the silver halide emulsion layers thereof in an alkaline aqueous solution. Various methods of using hydrophobic developing agents for the process are described in *Research Disclosure*, No. 16928, U.S. Pat. No. 2,739,890, British Patent 813,253 and West German patent 1,547,763. Such a development process may be combined with a silver salt stabilization process using a thiocyanate.

As a fix solution, a fixing composition which is conventionally used for such purpose can be used in this invention. As the fixing agent, there are thiosulfates and thiocyanates as well as organic sulfur compounds which are known to have the effect of a fixing agent. The fix solution may contain a water-soluble aluminum salt as a hardening agent.

A color developer is generally composed of an alkaline aqueous solution containing a color developing agent. As the color developing agent, there are, for example, aromatic primary amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-βmethanesulfonamidoethylaniline, and 4-amino-3-methyl-N-ethyl-N-β-methoxyethylaniline).

Other color developers for use in this invention are described in L. F. A. Mason, *Photographic Processing Chemistry*, pages 226 to 229, published by Focal Press, 1966, U.S. Pat. Nos. 2,193,015 and 2,592,364, and JP-A-48-64933.

The color developer can further contain a pH buffer, a development inhibitor and/or an antifoggant. Also, the color developer may contain, if necessary, a water softener, a preservative, an organic solvent, a development accelerator, a dye-forming coupler, a competing coupler, a fogging agent, an auxiliary developing agent, a tackifier, a polycarboxylic acid series chelating agent, an antioxidant, etc.

Examples of these additives are described in *Research Disclosure*, No. 17643, U.S. Pat. No. 4,083,723, and West German Patent Application (OLS) 2,622,950.

After color development, the photographic light-sensitive material is usually bleached. The bleach process may be carried out simultaneously with or separately from a fix process. As the bleaching agent, there are compounds of multivalent metals such as iron(III), cobalt(III), chromium(VI), copper(II), etc., peracids, quinones, and nitroso compounds.

For example, ferricyanides; bichromates; organic complex salts of iron(III) or cobalt(III), such as complex salts with an aminopolycarboxylic acid, such as ethylenediaminetetraacetic acid, nitrilotriacetic acid, 1,3-diamino-2-propanoltetraacetic acid, etc., or an organic salt such as citric acid, tartaric acid, malic acid, etc.; persulfates; permanganates; and nitrosophenols can be used. In these compounds, potassium ferricyanide, ethylenediaminetetraacetic acid iron(III) sodium, and ethylenediaminetetraacetic.acid iron(III) ammonium are particularly useful. The ethylenediaminetetraacetic acid iron(III) complex salts are useful for both a bleach solution and a monobath bleach-fix (blix) solution.

The bleach solution or the blix solution may further contain a bleach accelerator as described in U.S. Pat. Nos. 3,042,520 and 3,241,966, JP-B-45-8506 and 45-8836 and a thiol compound as described in JP-A-53-65732 or other various additives.

The photographic light-sensitive material of this invention can be processed by adding an additive to a processing solution such as the developer, the blix solution, etc., which reacts with the light-collecting dye added to the photographic light-sensitive material for the purpose of decomposing and decoloring the compound of this invention. Examples of such additives include compounds having a high nucleophilic property such as sodium sulfite, potassium bisulfite, hydroxylamine or hydroxamic acid.

This invention can be applied to various color and black-and-white photographic light-sensitive materials. Typical examples of the photographic materials are general or movie color negative photographic films, color reversal photographic films for slides or television, color photographic papers, color positive photographic films, color reversal photographic papers, color diffusion transfer photographic materials and heat development type color photographic materials. The invention can be also applied to black-and-white photographic materials such as X-ray photographic materials by utilizing a mixture of three color couplers as described in *Research Disclosure*, No. 17123, (July, 1978) or the black-coloring couplers described in U.S. Pat. No. 4,126,461 and British Patent 2,102,136.

This invention can be also applied to photographic films for printing plate-making, such as lithographic light-sensitive materials and scanner films, direct or indirect medical X-ray films or industrial X-ray films, negative black-and-white photographic films for camera use, black-and-white photographic papers, ordinary microfilms or microfilms for COM (computer-outputted microfilms), and printout type light-sensitive materials for silver salt diffusion transfer type photographic light-sensitive materials.

The technique of this invention is effective as a means for improving spectral sensitizing sensitivity as well as being expected to improve the sharpness of the images of the photographic light-sensitive materials because the light-collecting dye in the compound of this invention acts as a light-absorbent which shows antiirradiation effects or antihalation effects. That is, the use of an antiirradiation dye and antihalation dye is generally accompanied by desensitization due to a high filter effect. However, according to this invention, the sharpness of images can be improved while increasing sensitivity, i.e., without substantially reducing sensitivity.

For example, it is known that in a direct medical X-ray photographic material having emulsion layer on both surfaces of the support, crossover light, that is, the fluorescent light transmitting from an intensifying screen to the light-sensitive emulsion layer at the opposite side to the incident surface of the fluorescent light, can create sharpness problems. However, according to this invention, the absorption of light at the incident surface is greatly increased to increase sensitivity and, at the same time, intercept the crossover light, whereby it can be expected to greatly increase sharpness.

The following Examples are intended to illustrate the invention more practically but not to limit it in any way.

EXAMPLE 1

By simultaneously adding an aqueous silver nitrate solution and an aqueous solution of potassium iodide and potassium bromide to an aqueous solution of potassium bromide, potassium iodide and gelatin, a twin type silver iodobromide emulsion containing silver halide grains having a mean grain size of 0.6 μm and a spherical shape was prepared and then the emulsion was chemically sensitized using sodium thiosulfate and chloroauric acid to provide a light-sensitive silver iodobromide emulsion having a silver iodide content of 6 mol %. (Emulsion A).

To 1 liter of an aqueous solution of 2 wt % gelatin kept at a pAg of 9.5 were simultaneously added 10 wt % of an aqueous silver nitrate solution (based on the whole amount of the solution) and an aqueous solution of potassium bromide and potassium iodide and then, while keeping the pAg at 9.2, remaining 90 wt % of the aqueous silver nitrate solution and an aqueous solution of potassium bromide and potassium iodide were simultaneously added to the aforesaid mixture to provide a tabular grain silver halide emulsion having a mean projected area diameter of 1.6 μm, a mean thickness of 0.133 μm (aspect ratio of 12.0), and a mean silver iodide content of 12 mol % (uniform distribution). Then, the emulsion was chemically sensitized using sodium thiosulfate and chloroauric acid to provide a light-sensitive silver iodobromide emulsion (Emulsion B).

2.0 g/m² and 3.0 g/m², respectively, the silver amount and gelatin amount contained in the lower emulsion layer (Emulsion A) were 4.0 g/m² and 7.0 g/m², respectively, and the coated amount of gelatin in the surface protective layer was 1.0 g/m².

Dye-1

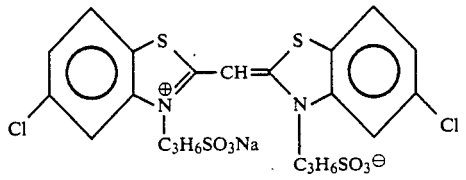

Dye-2

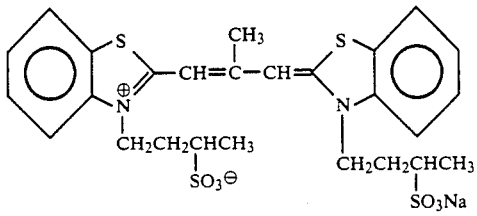

Dye-3

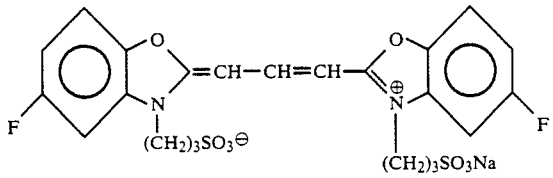

Dye-4

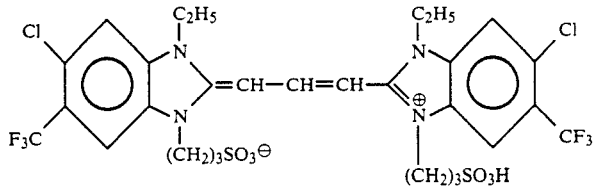

After adding spectral sensitizing dyes (Dye-1, Dye-2, Dye-3 and Dye-4 now shown) to Emulsion A in an amount of 0.1 mg, 0.7 mg, 0.7 mg, and 0.7 mg, respectively, per gram of silver, and adding the same dyes to Emulsion B in an amount of 0.2 mg, 1.4 mg, 1.4 mg, and 1.4 mg, respectively, per gram of silver, the emulsions were simultaneously coated with a gelatin surface protective layer on a cellulose triacetate film support having subbing layer and dried to Comparison Sample I-1. In this case, the silver amount and gelatin amount contained in the upper emulsion layer (Emulsion B) were Further, by following the same procedure as in the case of preparing Sample I-1, except that Luminous Dye A-1 shown below was added to Emulsion A and Emulsion B in an amount of $2.0\times10^{-5}$ mol per each gram of gelatin, Comparison Sample I-2 was prepared. On the other hand, by following the same procedure as the case of preparing Sample I-1, except that Luminous Dye B-1 was added to Emulsion A and Emulsion B in an amount of $2.0\times10^{-5}$ mol per each gram of gelatin, Comparison Sample I-3 was prepared.

A-1

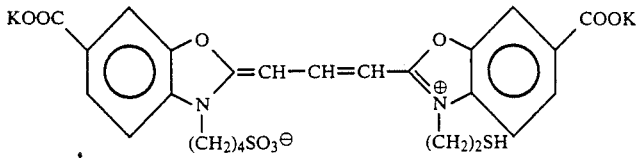

-continued

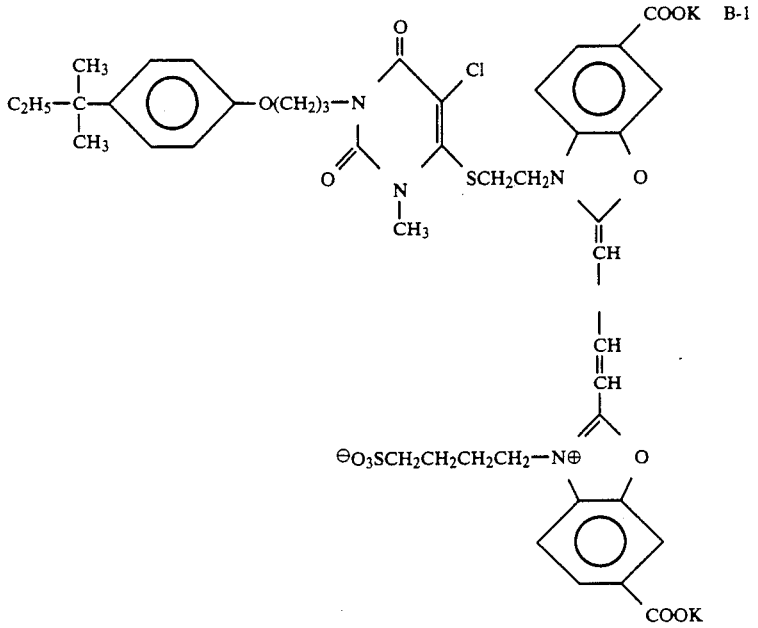

Each of these samples was exposed for 1/100 second by a light source having color temperature of 5,400° K., developed for 7 minutes by a developer having the composition shown below at 20° C., fixed by a fix solution having the composition shown below at 38° C. for 20 seconds, washed and dried. Then, the sensitivity thereof was evaluated by the relative value of the reciprocal of the exposure amount necessary for obtaining an optical density of fog +0.2. The results obtained are shown in Table 1 below.

| | |
|---|---|
| Developer: | |
| Metol | 2 g |
| Anhydrous Sodium Sulfite | 100 g |
| Hydroquinone | 5 g |
| Boric Acid | 2 g |
| Water to make | 1 liter |
| Fix Solution: | |
| Sodium Thiosulfate | 240 g |
| Anhydrous Sodium Sulfite | 15 g |
| 28% Acetic Acid | 48 ml |
| Boric Acid | 7.5 g |
| Potassium Alum | 15 g |
| Water to make | 1 liter |

TABLE 1

| Test No. | Light-Collecting Dye | Relative Sensitivity |
|---|---|---|
| I-1* | — | 100 |
| I-2* | A-1 | 107 |
| I-3** | B-1 | 145 |

*Comparative examples
**Example of this invention

As shown by the above results, in Comparative Sample I-2, the sensitivity was slightly higher than that of Sample I-1 by the light-collecting effect but since the diffusion of Dye A-1 occurs in the protective layer, a sufficient increase in sensitivity was not obtained by the filter effect of the protective layer. On the other hand, in Sample I-3 of this invention, Dye B-1 was fixed in Emulsion Layers A and B and hence an excellent sensitization effect was obtained. In addition, in Sample I-3, no residual color was substantially observed upon processing.

EXAMPLE 2

A multilayer color photographic material (Comparative Sample II-1) having the layers of the compositions shown below on a cellulose triacetate film support having subbing layers was prepared.

In the following compositions, the coated amounts are shown as g/m$^2$ unit per silver on the silver halide emulsion and colloidal silver, g/m$^2$ on the coupler, additives and gelatin, and mol number per mol of silver halide in the same layer on the sensitizing dye.

| | |
|---|---|
| First Layer: Antihalation Layer | |
| Black colloidal silver | 0.2 |
| Gelatin | 1.3 |
| ExM-8 | 0.06 |
| UV-1 | 0.1 |
| UV-2 | 0.2 |
| Solv-1 | 0.01 |
| Solv-2 | 0.01 |
| Second Layer: Interlayer | |
| Very fine grain silver bromide (mean grain size: 0.07 μm) | 0.10 |
| Gelatin | 1.5 |
| UV-1 | 0.06 |
| UV-2 | 0.03 |
| ExC-2 | 0.02 |
| ExF-1 | 0.004 |
| Solv-1 | 0.1 |
| Solv-2 | 0.09 |
| Third Layer: First Red-Sensitive Emulsion Layer | |
| Silver iodobromide emulsion (AgI: 2 mol %, internal high AgI type, diameter corresponding to sphere: 0.3 μm, coefficient of variation of diameters corresponding to sphere: 29%, normal crystal, twin mixed grains, aspect ratio: 2.5) | 0.4 |
| Gelatin | 0.6 |
| ExS-1 | $1.0 \times 10^{-4}$ |
| ExS-2 | $3.0 \times 10^{-4}$ |
| ExS-3 | $1 \times 10^{-5}$ |
| ExC-3 | 0.06 |
| ExC-4 | 0.06 |
| ExC-7 | 0.04 |
| ExC-2 | 0.03 |

-continued

| | |
|---|---|
| Solv-1 | 0.03 |
| Solv-3 | 0.012 |
| Fourth Layer: Second Red-Sensitive Emulsion Layer | |
| Silver iodobromide emulsion (AgI: 5 mol %, internal high AgI type, diameter corresponding to sphere: 0.7 μm, coefficient of variation of sphere-corresponding diameter: 25%, normal crystal, twin mixed grains, aspect ratio: 4) | 0.7 |
| Gelatin | 0.5 |
| ExS-1 | $1 \times 10^{-4}$ |
| Exs-2 | $3 \times 10^{-4}$ |
| ExS-3 | $1 \times 10^{-5}$ |
| ExC-3 | 0.24 |
| ExC-4 | 0.24 |
| ExC-7 | 0.04 |
| ExC-2 | 0.04 |
| Solv-1 | 0.15 |
| Solv-3 | 0.02 |
| Fifth Layer: Third Red-Sensitive Emulsion Layer | |
| Silver iodobromide emulsion (AgI: 10 mol %, internal high AgI type, sphere-corresponding diameter: 0.8 μm, coefficient of variation of sphere-corresponding diameter: 16%, normal crystal, twin mixed grains, aspect ratio: 1.3) | 1.0 |
| Gelatin | 1.0 |
| ExS-1 | $1 \times 10^{-4}$ |
| ExS-2 | $3 \times 10^{-4}$ |
| ExS-3 | $1 \times 10^{-5}$ |
| ExC-5 | 0.05 |
| ExC-6 | 0.1 |
| Solv-1 | 0.01 |
| Solv-2 | 0.05 |
| Sixth Layer: Interlayer | |
| Gelatin | 1.0 |
| Cpd-1 | 0.03 |
| Solv-1 | 0.05 |
| Seventh Layer: First Green-Sensitive Emulsion Layer | |
| Silver iodobromide emulsion (AgI: 2 mol %, internal high AgI type, sphere-corresponding diameter: 0.3 μm, coefficient of sphere-corresponding diameter: 28%, normal crystal, twin mixed grains, aspect ratio: 2.5) | 0.30 |
| Gelatin | 1.0 |
| ExS-4 | $5 \times 10^{-4}$ |
| ExS-6 | $0.3 \times 10^{-4}$ |
| ExS-5 | $2 \times 10^{-4}$ |
| ExM-9 | 0.2 |
| ExY-14 | 0.03 |
| ExM-8 | 0.03 |
| Solv-1 | 0.5 |
| Eighth Layer: Second Green-Sensitive Emulsion Layer | |
| Silver iodobromide emulsion (AgI: 4 mol %, internal high AgI type, sphere-corresponding diameter: 0.6 μm, coefficient of variation of sphere-corresponding diameter: 38%, normal crystal, twin mixed grains, aspect ratio: 4) | 0.4 |
| Gelatin | 0.5 |
| ExS-4 | $5 \times 10^{-4}$ |
| ExS-5 | $2 \times 10^{-4}$ |
| ExS-6 | $0.3 \times 10^{-4}$ |
| ExM-9 | 0.25 |
| ExM-8 | 0.03 |
| ExM-10 | 0.015 |
| ExY-14 | 0.01 |
| Solv-1 | 0.2 |

-continued

| | |
|---|---|
| Ninth Layer: Third Green-Sensitive Emulsion Layer | |
| Silver iodobromide emulsion (AgI: 6 mol %, internal high AgI type, sphere-corresponding diameter: 1.0 μm, coefficient of variation of sphere-corresponding diameter: 80%, normal crystal, twin mixed grains, aspect ratio: 1.2) | 0.85 |
| Gelatin | 1.0 |
| ExS-7 | $3.5 \times 10^{-4}$ |
| ExS-8 | $1.4 \times 10^{-4}$ |
| ExM-11 | 0.01 |
| ExM-12 | 0.03 |
| ExM-13 | 0.20 |
| ExM-8 | 0.02 |
| ExY-15 | 0.02 |
| Solv-1 | 0.20 |
| Solv-2 | 0.05 |
| Tenth Layer: Yellow Filter Layer | |
| Gelatin | 1.2 |
| Yellow colloidal silver | 0.08 |
| Cpd-2 | 0.1 |
| Solv-1 | 0.3 |
| Eleventh Layer: First Blue-Sensitive Emulsion Layer | |
| Silver iodobromide emulsion (AgI: 4 mol %, internal high AgI type, sphere-corresponding diameter: 0.5 μm, coefficient of variation of sphere-corresponding diameter: 15%, octahedral grains) | 0.4 |
| Gelatin | 1.0 |
| ExS-9 | $2 \times 10^{-4}$ |
| ExY-16 | 0.9 |
| ExY-14 | 0.07 |
| Solv-1 | 0.2 |
| Twelfth Layer: Second Blue-Sensitive Emulsion Layer | |
| Silver iodobromide emulsion (AgI: 10 mol %, internal high AgI type, sphere-corresponding diameter: 1.3 μm, coefficient of variation of sphere-corresponding diameter: 25%, normal crystal, twin mixed grains, aspect ratio: 4.5) | 0.5 |
| Gelatin | 0.6 |
| ExS-9 | $1 \times 10^{-4}$ |
| ExY-16 | 0.25 |
| Solv-1 | 0.07 |
| Thirteenth Layer: First Protective Layer | |
| Gelatin | 0.8 |
| UV-1 | 0.1 |
| UV-2 | 0.2 |
| Solv-1 | 0.01 |
| Solv-2 | 0.01 |
| Fourteenth Layer: Second Protective Layer | |
| Fine grain silver bromide (mean grain size: 0.07 μm) | 0.5 |
| Gelatin | 0.45 |
| Polymethyl methacrylate particles (diameter: 1.5 μm) | 0.2 |
| H-1 | 0.4 |
| Cpd-3 | 0.5 |
| Cpd-4 | 0.5 |

Each of the layers described above further contained a surface active agent as a coating aid in addition to the aforesaid components. Thus, Comparative Sample II-1 was prepared.

The compounds used for the above sample were as follows.

UV-1

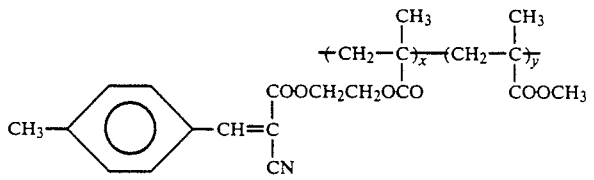

x/y = 7/3 (weight ratio)

-continued
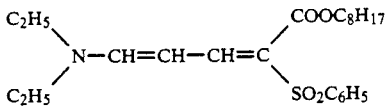
UV-2
Tricresyl Phosphate — Solv-1
Dibutyl Phthalate — Solv-2
Bis(2-ethylhexyl)phthalate — Solv-3
ExM-8
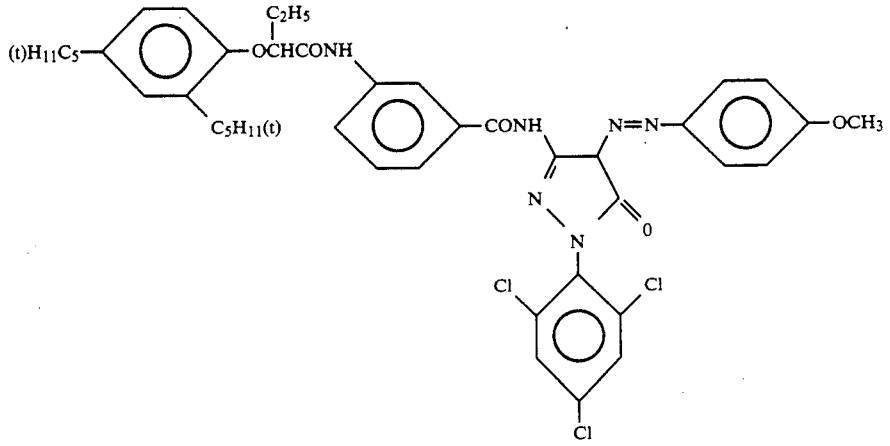
ExF-1
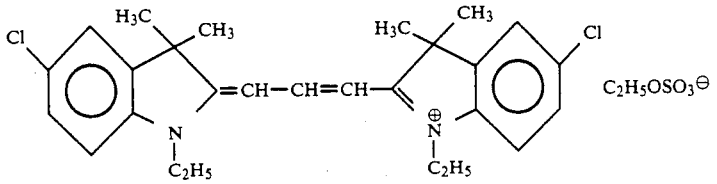
ExC-2
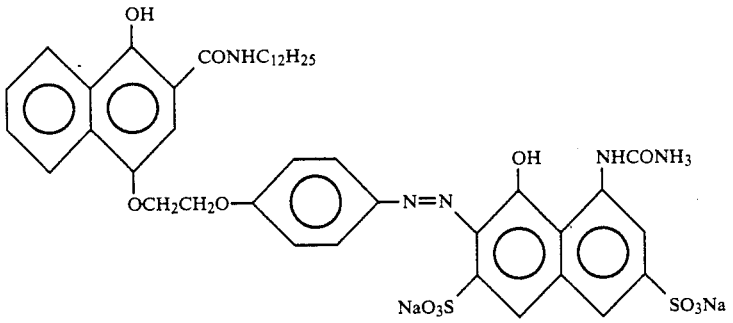
ExC-3
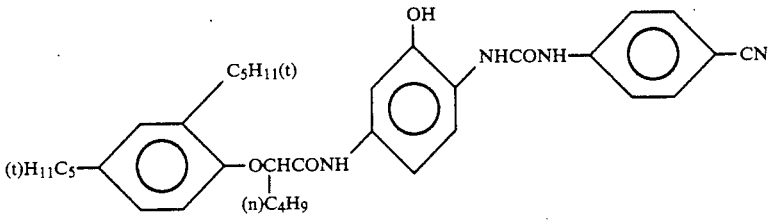
ExC-4
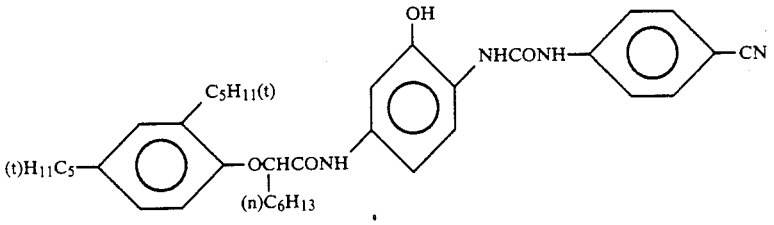

-continued
ExY-14
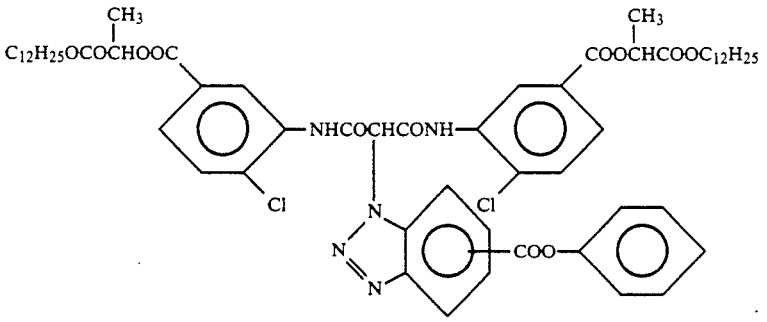
ExY-15
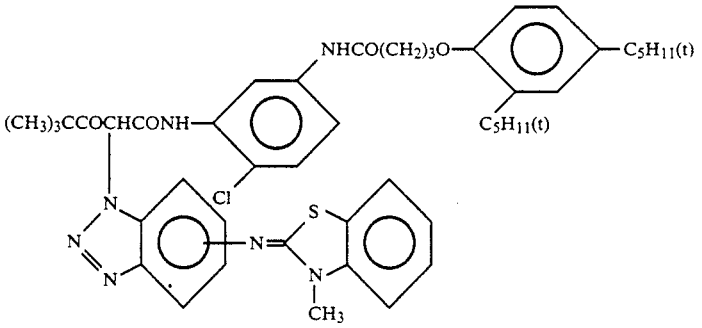
ExC-5
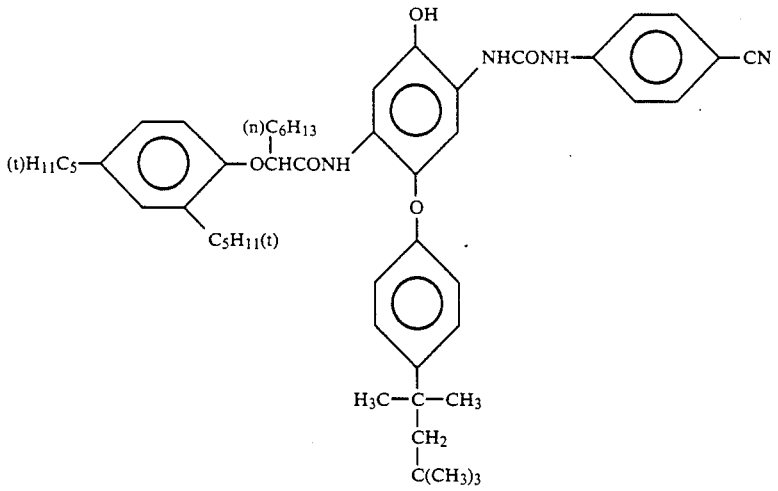
ExC-6
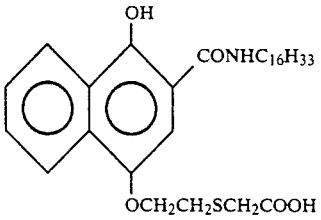

-continued
ExC-7
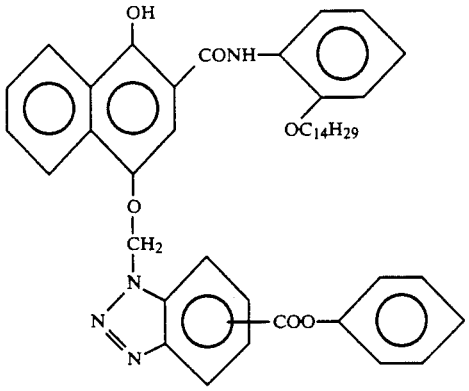
ExM-9
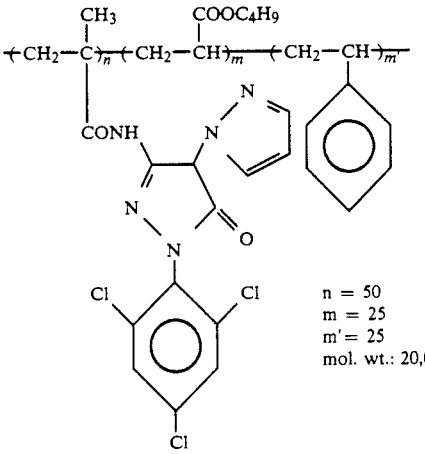
n = 50
m = 25
m' = 25
mol. wt.: 20,000
ExM-10
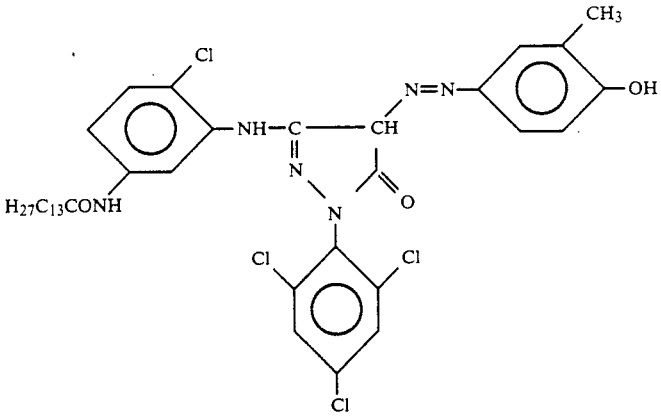
ExM-11
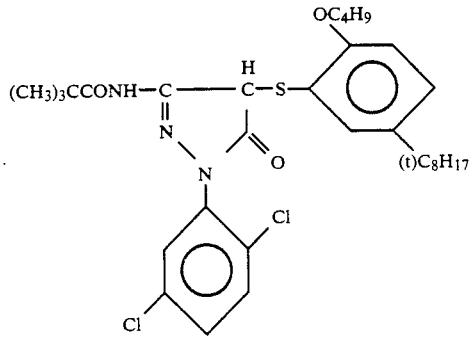

-continued
ExM-12
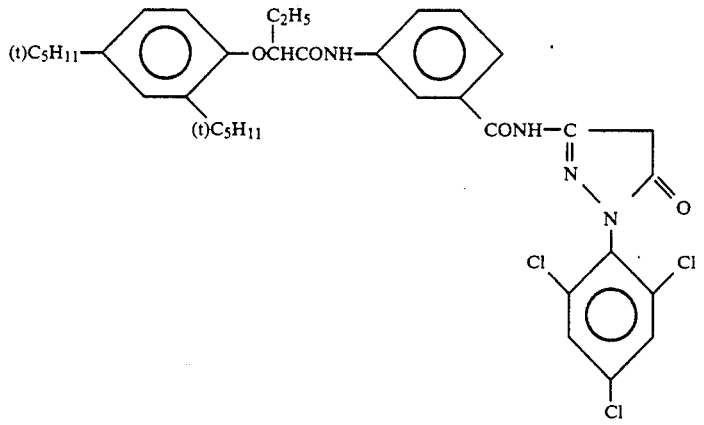
ExM-13
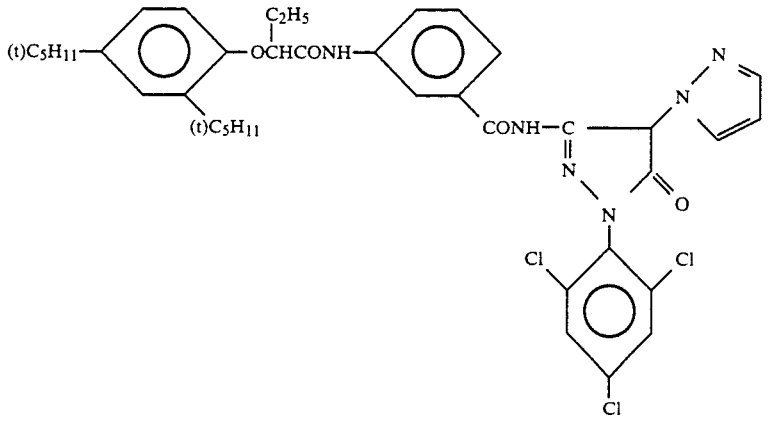
ExY-16
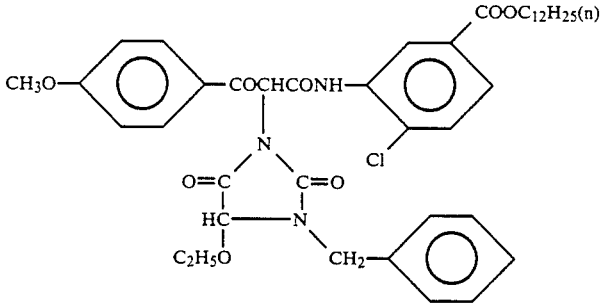
Cpd-1
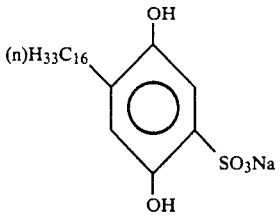
Cpd-2
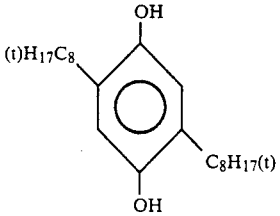

-continued
ExS-1
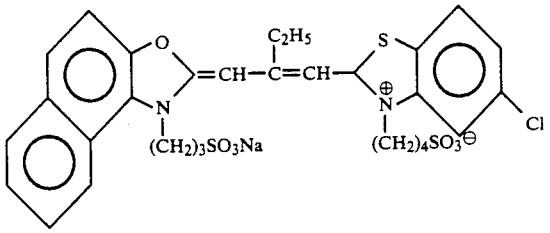
ExS-2
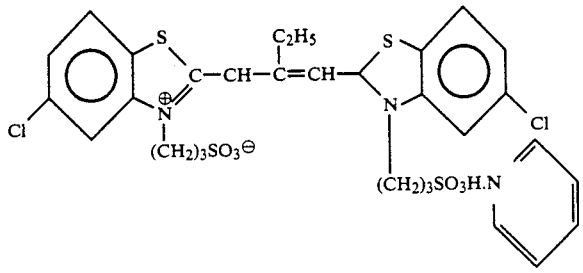
ExS-3
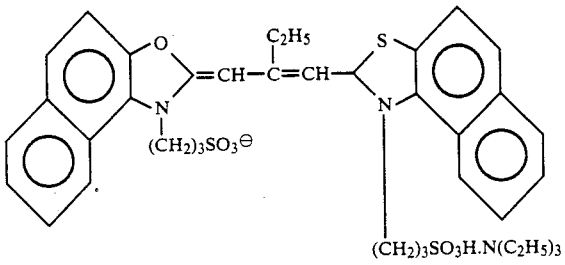
ExS-4
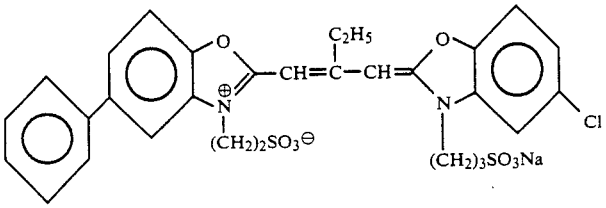
ExS-5
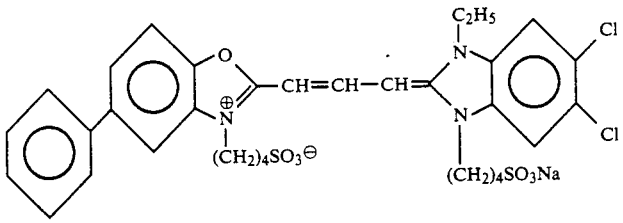
ExS-6
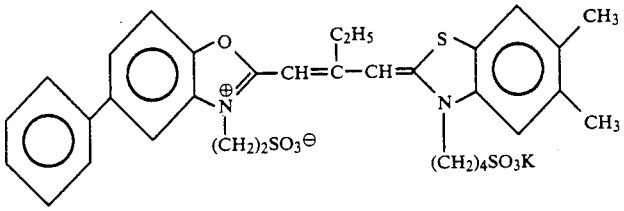
ExS-7
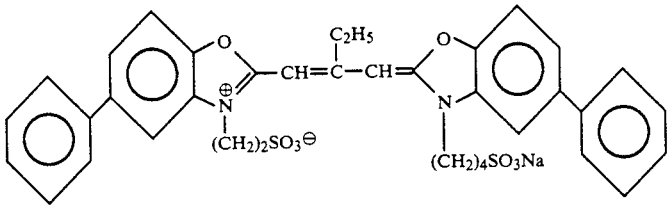

-continued

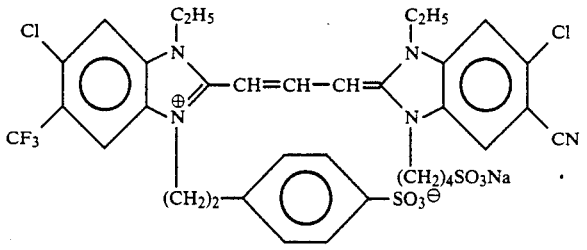

ExS-8

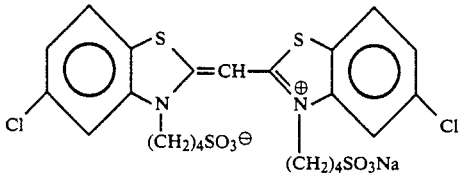

ExS-9

$CH_2{=}CH{-}SO_2{-}CH_2{-}CONH{-}CH_2$
$CH_2{=}CH{-}SO_2{-}CH_2{-}CONH{-}CH_2$

H-1

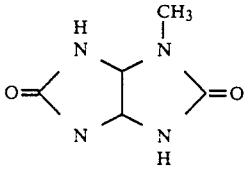

Cpd-3

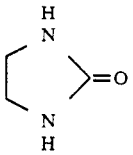

Cpd-4

By following the same procedure as the case of preparing Comparative Sample II-1 while further adding diffusible light-collecting Dye A-2 shown below to the first to third red-sensitive emulsion layers, Dye A-1 shown in Example 1 to the first to third green-sensitive emulsions layers, and Dye A-3 shown below to the first and second blue-sensitive emulsion layers each in an amount of $2.0\times10^{-5}$ mol per gram of gelatin, Comparative Sample II-2 was prepared.

Furthermore, by following the same procedure as above while adding light-collecting Dyes B-2, B-1 (Dye B-1 was shown in Example 1), and B-3 each to the first to third red-sensitive emulsion layers, the first to third green-sensitive emulsion layers, and the first and second blue-sensitive emulsion layers, respectively, each in an amount of $2.0\times10^{-5}$ mol per gram of gelatin, Sample II-3 of this invention was prepared.

Light-collecting Dyes A-2, A-3, B-2 and B-3 used above were as follows and Dyes A-1 and B-1 were shown in Example 1.

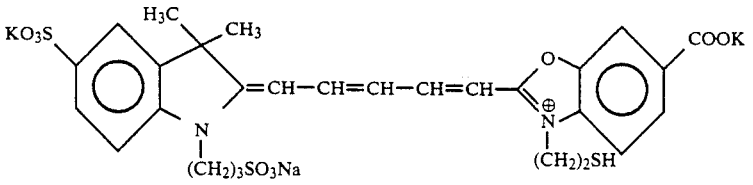

A-2

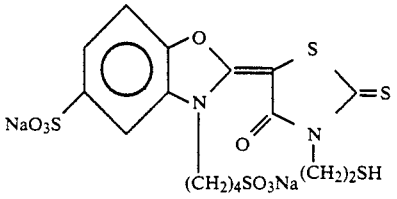

A-3

-continued

B-2

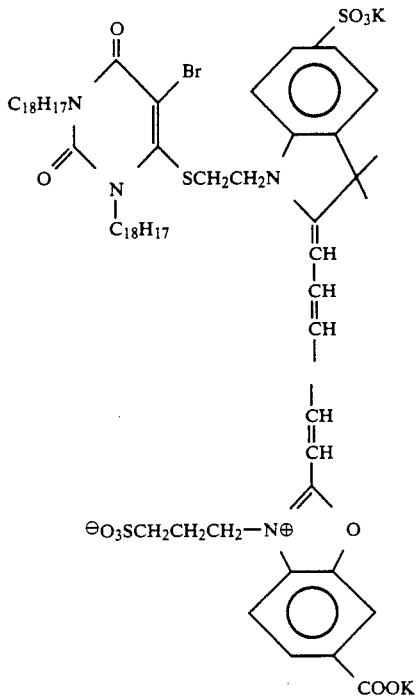

B-3

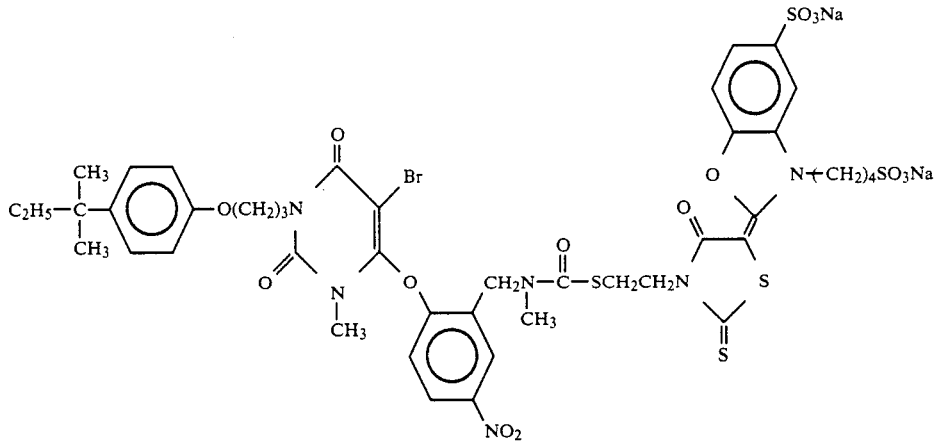

Each of the samples was light-exposed for 1/100 second through a continuous wedge using a light source of 4,800° K. and processed as follows.

| Processing Step | Processing Time | Processing Temperature (°C.) |
|---|---|---|
| Color Development | 3 min 15 sec | 38 |
| Bleach | 6 min 30 sec | 38 |
| Wash | 2 min 10 sec | 24 |
| Fix | 4 min 20 sec | 38 |
| Wash (1) | 1 min 05 sec | 24 |
| Wash (2) | 1 min 00 sec | 24 |
| Stabilization | 1 min 05 sec | 38 |
| Drying | 4 min 20 sec | 55 |

The compositions of the processing solutions used in the aforesaid processing steps were as follows (washing was with water).

| | |
|---|---|
| Color Developer: | |
| Diethylenetriaminepentaacetic Acid | 1.0 g |

-continued

| | |
|---|---|
| 1-Hydroxyethylidene-1,1-diphosphonic Acid | 3.0 g |
| Sodium Sulfite | 4.0 g |
| Potassium Carbonate | 30.0 g |
| Potassium Bromide | 1.4 g |
| Potassium Iodide | 1.5 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| pH | 10.05 |
| Bleach Solution: | |
| Ethylenediaminetetraacetic Acid Ferric Sodium Trihydrate | 100.0 g |
| Ethylenediaminetetraacetic Acid Disodium Salt | 10.0 g |
| Ammonium Bromide | 140.0 g |
| Ammonium Nitrate | 30.0 g |
| Aqueous Ammonia (27%) | 6.5 ml |
| Water to make | 1.0 liter |
| pH | 6.0 |
| Fix Solution: | |
| Ethylenediaminetetraacetic Acid Disodium Salt | 0.5 g |
| Sodium Sulfite | 7.0 g |
| Sodium Hydrogensulfite | 5.0 g |

-continued

| | |
|---|---|
| Aqueous Solution of 70% Ammonium Thiosulfate | 170.0 ml |
| Water to make | 1.0 liter |
| pH | 6.7 |
| Stabilization Solution: | |
| Formalin (37%) | 2.0 ml |
| Polyoxyethylene-p-monononylphenyl Ether (mean degree of polymerization: 10) | 0.3 |
| Ethylenediaminetetraacetic Acid Disodium Salt | 0.05 |
| Water to make | 1.0 liter |
| pH | 5.0 to 8.0 |

The relative values of the reciprocals of the exposure amounts to reach optical densities of fog +0.2 in the cyan, magenta and yellow corresponding to the red-sensitive emulsion layers, green-sensitive emulsion layers and blue-sensitive emulsion layers of each sample thus processed are shown in Table 2 below as R sensitivity, G sensitivity and B sensitivity, respectively.

TABLE 2

| Sample No. | Light-Collecting Dye | R Sensitivity | G Sensitivity | B Sensitivity |
|---|---|---|---|---|
| II-1* | — | 100 | 100 | 100 |
| II-2* | A-2/A-1/A-3 | 93 | 95 | 98 |
| II-3** | B-2/B-1/B-3 | 119 | 130 | 120 |

As is clear from the results shown above, in Comparative Sample II-2, desensitization occurred due to diffusion of the light-collecting dye into other layers but in Sample II-3 of this invention, a sensitizing effect was obtained since the light-collecting dyes were fixed in each emulsion layer.

EXAMPLE 3

A multilayer color photographic material (Comparative Sample III-1) having layers of the following compositions on a cellulose triacetate film support having subbing layers was prepared.

| | |
|---|---|
| First Layer: Antihalation Layer | |
| A gelatin layer (dry thickness of 2 μm) containing: | |
| Black colloidal silver | 0.25 g/m$^2$ |
| Ultraviolet Absorbent U-1 | 0.04 g/m$^2$ |
| Ultraviolet Absorbent U-2 | 0.1 g/m$^2$ |
| Ultraviolet Absorbent U-3 | 0.1 g/m$^2$ |
| High Boiling Organic Solvent O-1 | 0.1 ml/m$^2$ |
| Second Layer: Interlayer | |
| A gelatin layer (dry thickness of 1 μm) containing: | |
| Compound H-1 | 0.05 g/m$^2$ |
| High Boiling Organic Solvent O-2 | 0.05 ml/m$^2$ |
| Third Layer: First Red-Sensitive Emulsion Layer | |
| A gelatin layer (dry thickness of 1 μm) containing: | |
| Silver iodobromide emulsion spectrally sensitized by Sensitizing Dyes S-1 and S-2 (iodine content: 4 mol %, mean grain size: 0.3 μm, S-1/S-2 is 95/5 by weight) | 0.5 g/m$^2$ as Ag |
| Coupler C-1 | 0.2 g/m$^2$ |
| Coupler C-2 | 0.05 g/m$^2$ |
| High Boiling Organic Solvent O-2 | 0.12 ml/m$^2$ |
| Fourth Layer: Second Red-Sensitive Emulsion Layer | |
| A gelatin layer (dry thickness of 2.5 μm) containing: | |
| Silver iodobromide emulsion spectrally sensitized by Sensitizing Dyes S-1 and S-2 (iodine content: 2.5 mol %, mean grain size: 0.55 μm, S-1/S-2 is 95/5 by weight) | 0.8 g/m$^2$ as Ag |
| Coupler C-1 | 0.55 g/m$^2$ |
| Coupler C-2 | 0.14 g/m$^2$ |
| High Boiling Organic Solvent O-2 | 0.33 ml/m$^2$ |
| Fifth Layer: Interlayer | |
| A gelatin layer (dry thickness of 1 μm) containing: | |
| Compound H-1 | 0.1 g/m$^2$ |
| High Boiling Organic Solvent O-2 | 0.1 ml/m$^2$ |
| Sixth Layer: First Green-Sensitive Emulsion Layer | |
| A gelatin layer (dry thickness of 1 μm) containing: | |
| Silver iodobromide emulsion spectrally sensitized by Sensitizing Dyes S-3 and S-4 (iodine content: 3 mol %, mean grain size: 0.3 μm, S-3/S-4 is 80/20 by weight) | 0.7 g/m$^2$ as Ag |
| Coupler C-3 | 0.35 g/m$^2$ |
| High Boiling Organic Solvent O-2 | 0.26 ml/m$^2$ |
| Seventh Layer: Second Green-Sensitive Emulsion Layer | |
| A gelatin layer (dry thickness of 2.5 μm) containing: | |
| Silver iodobromide emulsion Spectrally sensitized by Sensitizing Dyes S-3 and S-4 (iodine content: 2.5 mol %, mean grain size: 0.8 μm, S-3/S-4 is 80/20 by weight) | 0.7 g/m$^2$ as Ag |
| Coupler C-4 | 0.25 g/m$^2$ |
| High Boiling Organic Solvent O-2 | 0.05 ml/m$^2$ |
| Eighth Layer: Interlayer | |
| A gelatin layer (dry thickness of 1 μm) containing: | |
| Compound H-1 | 0.05 g/m$^2$ |
| High Boiling Organic Solvent-2 | 0.1 ml/m$^2$ |
| Ninth Layer: Yellow Filter Layer | |
| A gelatin layer (dry thickness of 1 μm) containing: | |
| Yellow colloidal silver | 0.1 g/m$^2$ |
| Compound H-1 | 0.02 g/m$^2$ |
| Compound H-2 | 0.03 g/m$^2$ |
| High Boiling Organic Solvent O-2 | 0.04 ml/m$^2$ |
| Tenth Layer: First Blue-Sensitive Emulsion Layer | |
| A gelatin layer (dry thickness of 1.5 μm) containing: | |
| Silver iodobromide emulsion spectrally sensitized by Sensitizing Dye S-5 (iodine content: 2.5 mol %, mean grain size: 0.7 μm) | 0.6 g/m$^2$ as Ag |
| Coupler C-5 | 0.5 g/m$^2$ |
| High Boiling Organic Solvent O-2 | 0.1 ml/m$^2$ |
| Eleventh Layer: Second Blue-Sensitive Emulsion Layer | |
| A gelatin layer (dry thickness of 3 μm) containing: | |
| Silver iodobromide emulsion spectrally sensitized by Sensitizing Dye S-5 (iodine content: 2.5 mol %, mean grain size: 1.2 μm) | 1.1 g/m$^2$ as Ag |
| Coupler C-5 | 1.2 g/m$^2$ |
| High Boiling Organic Solvent O-2 | 0.23 ml/m$^2$ |
| Twelfth Layer: First Protective Layer | |
| A gelatin layer (dry thickness of 2 μm) containing: | |
| Ultraviolet Absorbent U-1 | 0.02 g/m$^2$ |
| Ultraviolet Absorbent U-2 | 0.03 g/m$^2$ |
| Ultraviolet Absorbent U-3 | 0.03 g/m$^2$ |
| Ultraviolet Absorbent U-4 | 0.29 g/m$^2$ |
| High Boiling Organic Solvent O-1 | 0.28 ml/m$^2$ |
| Thirteenth Layer: Second Protective Layer | |
| A gelatin layer (dry thickness of 0.8 μm) containing: | |
| Surface-fogged fine grain silver iodobromide emulsion (iodine content: 1 mol %, mean grain size: 0.06 μm) | 0.1 g/m$^2$ as Ag |
| Polymethyl methacrylate particles (mean grain size: 1.5 μm) | 0.2 g/m$^2$ |

Each layer further contained Gelatin Hardening Agent H-3 and a surface active agent in addition to the aforesaid components.

The compounds employed for preparing the above sample were as follows.

C-1
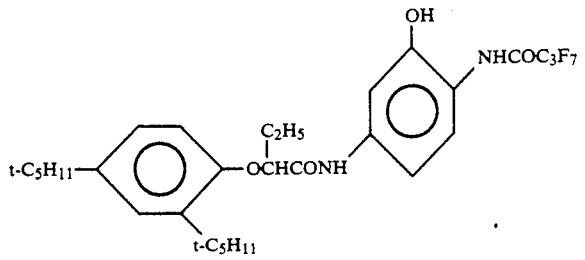
C-2
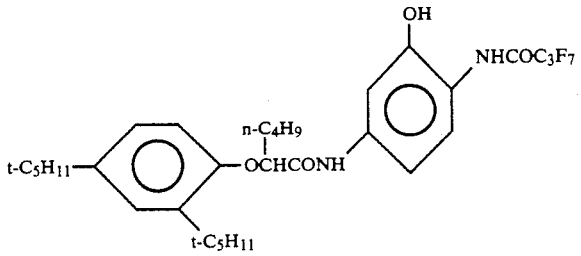
C-3
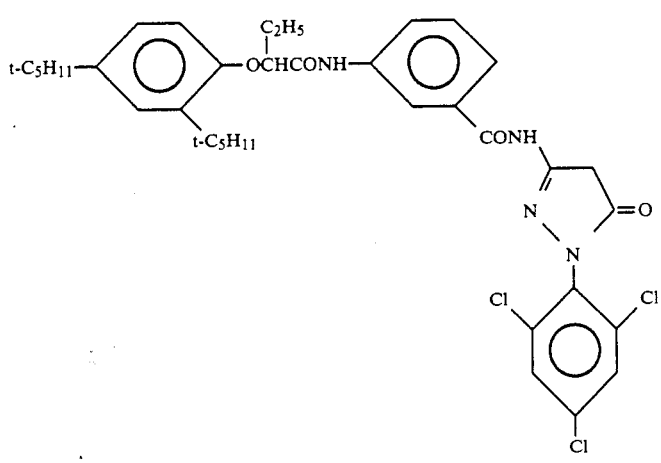
C-4
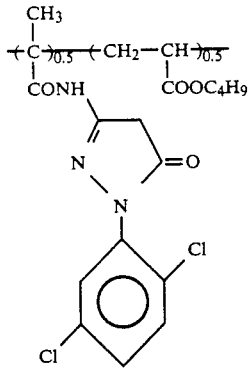
C-5
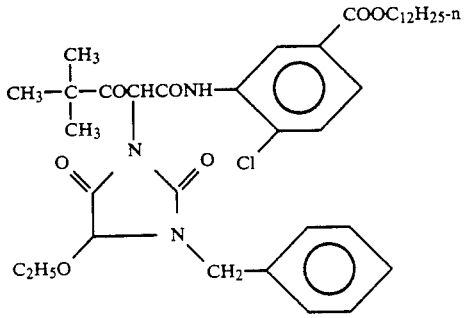

-continued
U-1
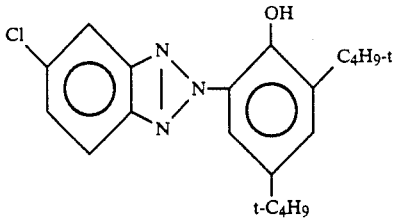
U-2
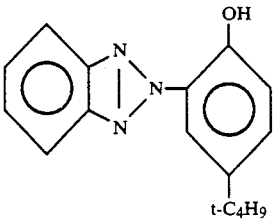
U-3
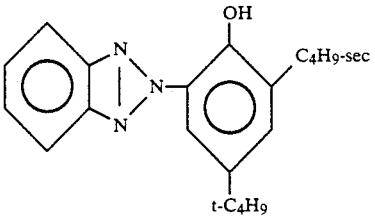
U-4
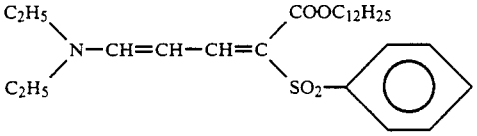
H-1
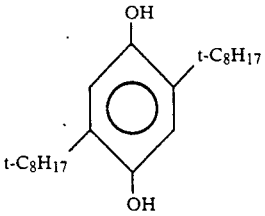
H-2
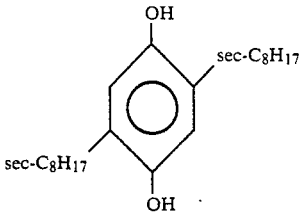
H-3
$CH_2{=}CHSO_2CH_2CONHCH_2$
$CH_2{=}CHSO_2CH_2CONHCH_2$
0-1
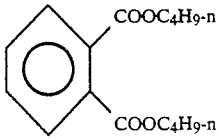
0-2
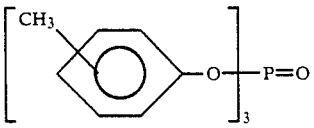

-continued

S-1

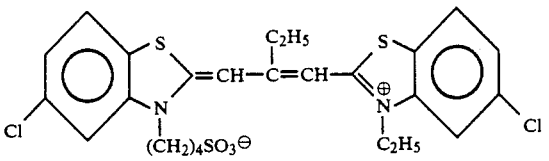

S-2

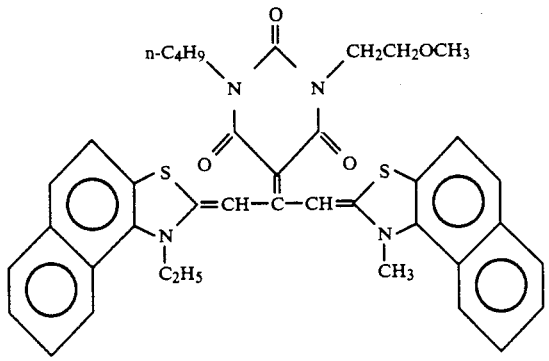

S-3

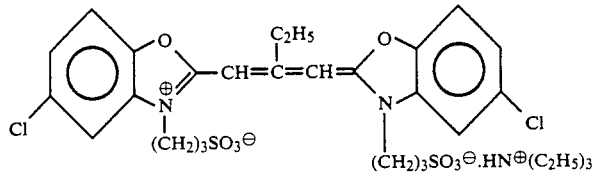

S-4

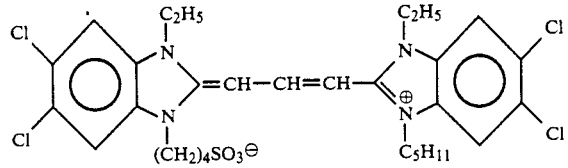

S-5

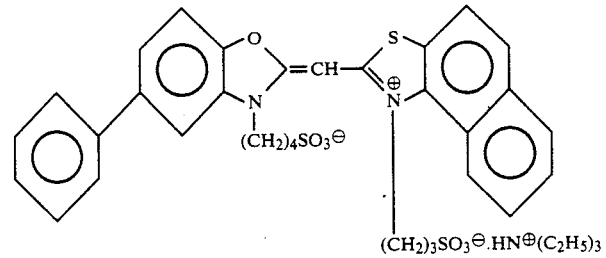

Then, by following the same procedure as in the case of preparing Comparative Sample III-1 while further adding diffusible light-collecting Dye A-2 (shown in Example 2) to the first and second red-sensitive emulsion layers, Dye A-1 (shown in Example 1) to the first and second green-sensitive emulsion layers, and Dye A-3 (shown in Example 2) to the first and second blue-sensitive emulsion layers each in an amount of $2.0\times10^{-5}$ mol per gram of gelatin, Comparative Sample III-2 was prepared. Also, by following the same procedure as in the preparation of Comparative Sample III-1 while adding light-collecting Dyes B-2, B-1 (identified in Example 1) and B-3 of this invention each to the first and second red-sensitive emulsion layers, the first and second green-sensitive emulsion layers, and the first and second blue-sensitive emulsion layers in an amount of $2.0\times10^{-5}$ mol per gram of gelatin, Sample III-3 of this invention was prepared. (Dye B-1 was shown in Example 1 and Dyes B-2 and B-3 were shown in Example 2).

Each of the samples was light-exposed for 1/100 second through a continuous wedge using a light source of 4,800° K. and processed as follows.

| Processing Step | Time (min) | Temperature (°C.) |
|---|---|---|
| First Development | 6 | 38 |
| Wash | 2 | 38 |
| Reversal | 2 | 38 |
| Color Development | 6 | 38 |
| Control | 2 | 38 |
| Bleach | 6 | 38 |
| Fix | 4 | 38 |
| Wash | 4 | 38 |
| Stabilization | 1 | 25 |

The compositions of the processing solutions were as follows.

| | |
|---|---|
| First Developer: | |
| Nitrilo-N,N,N-trimethylenephosphonic Acid.5-Sodium Salt | 2.0 g |
| Sodium Sulfite | 30 g |
| Hydroquinone Potassium Monosulfate | 20 g |
| Potassium Carbonate | 33 g |
| 1-Phenyl-4-methyl-4-hydroxymethyl-3-pyrazolidone | 2.0 g |
| Potassium Bromide | 2.5 g |
| Potassium Thiocyanate | 1.2 g |
| Potassium Iodide | 2.0 mg |
| Water to make | 1 liter |
| pH | 9.60 |
| The pH was controlled by hydrochloric acid or potassium bromide. | |
| Reversal Solution: | |
| Nitrilo-N,N,N-trimethylenephosphonic Acid.5-Sodium Salt | 3.0 g |
| Stannous Chloride.Dihydrate | 1.0 g |
| p-Aminophenol | 0.1 g |
| Sodium Hydroxide | 8 g |
| Glacial Acetic Acid | 15 ml |
| Water to make | 1 liter |
| pH | 6.00 |
| The pH was controlled by hydrochloric acid or sodium hydroxide. | |
| Color Developer: | |
| Nitrilo-N,N,N-trimethylenephosphonic Acid.5-Sodium Salt | 2.0 g |
| Sodium Sulfite | 7.0 g |
| Trisodium Phosphate.12-Hydrate | 36 g |
| Potassium Bromide | 1.0 g |
| Potassium Iodide | 90 mg |
| Sodium Hydroxide | 3.0 g |
| Citrazinic Acid | 1.5 g |
| N-Ethyl-N-(β-methanesulfonamidoethyl)-3-methyl-4-aminoaniline Sulfate | 11 g |
| 3,6-Dithiaoctane-1,8-diol | 1.0 g |
| Water to make | 1 liter |
| pH | 11.80 |
| The pH was controlled by hydrochloric acid or potassium hydroxide. | |
| Control Solution: | |
| Ethylenediaminetetraacetic Acid.Disodium Salt.Dihydrate | 8.0 g |
| Sodium Sulfite | 12 g |
| 1-Thioglycerol | 0.4 ml |
| Water to make | 1 liter |
| pH | 6.20 |
| The pH was controlled by hydrochloric acid or sodium hydrochloride. | |
| Bleach Solution: | |
| Ethylenediaminetetraacetic Acid.Disodium Salt.Dihydrate | 2.0 g |
| Ethylenediaminetetraacetic Acid. Fe(III).Ammonium.Dihydrate | 120 g |
| Potassium Bromide | 100 g |
| Ammonium Nitrate | 10 g |
| Water to make | 1 liter |
| pH | 5.70 |
| The pH was controlled by hydrochloric acid or sodium hydroxide. | |
| Fix Solution: | |
| Ammonium Thiosulfate | 80 g |
| Sodium Sulfite | 5.0 g |
| Sodium Hydrogensulfite | 5.0 g |
| Water to make | 1 liter |
| pH | 6.60 |
| The pH was controlled by hydrochloric acid or aqueous ammonia. | |
| Stabilization Solution: | |
| Formalin (37%) | 5.0 ml |
| Polyoxyethylene-p-monononylphenyl Ether (mean degree of polymerization: 10) | 0.5 ml |
| Water to make | 1 liter |
| pH not controlled. | |

The relative values of the reciprocals of the exposure amounts to reach optical densities of 1.0 in the cyan, magenta and yellow corresponding to the red-sensitive emulsion layers, the green-sensitive emulsion layers, and blue-sensitive emulsion layers of each sample thus processed are shown in Table 3 below as R sensitivity, G sensitivity and B sensitivity.

TABLE 3

| Test No. | Light-Collecting Seed | R Sensitivity | G Sensitivity | B Sensitivity |
|---|---|---|---|---|
| III-1* | — | 100 | 100 | 100 |
| III-2* | A-2/A-1/A-3 | 93 | 95 | 96 |
| III-3** | B-2/B-1/B-3 | 129 | 131 | 116 |

*Comparative samples
**Sample of this invention

As shown in the above table, in Comparative Sample III-2, desensitization occurred due to the diffusion of the light-collecting dyes into other layers but in Sample III-3 of this invention, a sensitization effect was obtained since the light-collecting dyes were fixed in each light-sensitive emulsion layer.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer spectrally sensitized by at least one adsorptive spectral sensitizing dye, wherein the emulsion layer or a hydrophilic colloid layer adjacent to the emulsion layer contains at least one compound represented by the following formula (I);

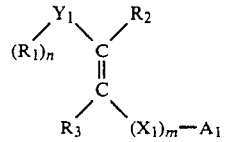

(I)

wherein $R_1$ represents a hydrogen atom or a group which may be substituted; $R_2$, and $R_3$ each independently represents a hydrogen atom, a halogen atom or a group which may be substituted; said $R_1$ and $R_2$ or said $R_1$ and $R_3$ may combine with each other to form a carbon ring or a heterocyclic ring; $Y_1$ represents

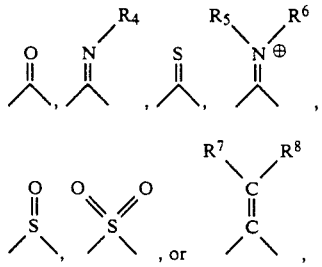

wherein $R_4$, $R_5$, $R_6$, $R_7$ and $R_8$ each independently represents a hydrogen atom or a group which may be substituted, a cyano group, or a nitro group; $A_1$ represents a light-collecting dye moiety selected from a cyanine dye moiety or a merocyanine dye moiety and which has an absorption maximum in a region of 3000 n.m. or longer, and which simultaneously satisfies the following factors (1) and (2), and is bonded to $X_1$ or the carbon atom through the hetero atom of $A_1$; $X_1$ represents a divalent linkage group bonded to the carbon atom through the hetero group of $X_1$; and m and n each represents 0 or 1; wherein said compound of formula (I) is capable of releasing the light collecting dye by the addition of a nucleophilic agent to the unsaturated bond of the compound of formula (I) on photographic processing;

(1) the luminous quantum yield of the dye is at least 0.001 at room temperature at a concentration of $10^{-4}$ mole/dm$^3$ in dry gelatin, and (2) the dye has a luminous zone at least partially overlapping with the optical adsorption zone of the adsorptive spectral sensitizing dye adsorbed in silver halide.

2. The silver halide photographic material as in claim 1, wherein said luminous quantum yield of the dye is not more than 1.

3. The silver halide photographic material as in claim 1, wherein $-X_1)_m$-$A_1$ in formula (I) is represented by the following formula:

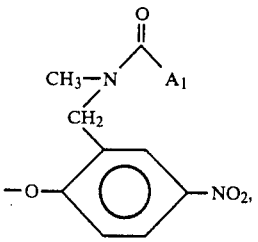

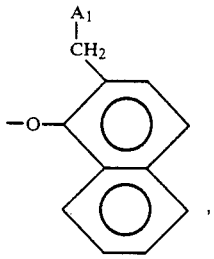

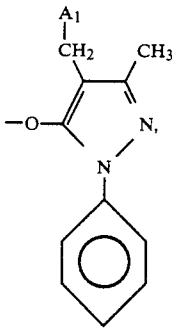

$-O-\underset{\underset{O}{\|}}{C}-A_1$, $-OCH_2-A_1$, $-O-\underset{\underset{O}{\|}}{C}-OCH_2-A_1$,

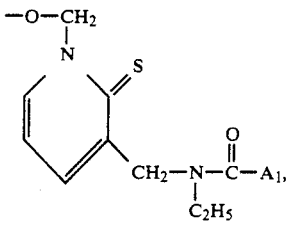

-continued

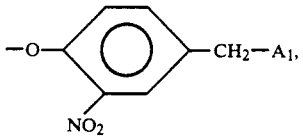

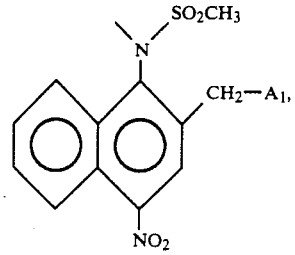

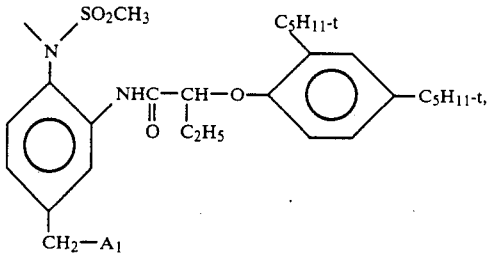

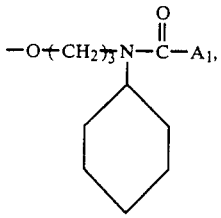

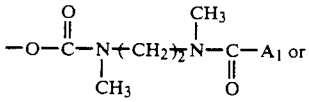

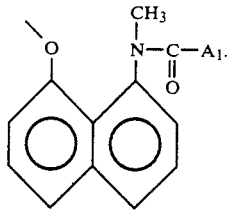

4. The silver halide photographic material as in claim 1, wherein $R_1$ in formula (I) represents a hydrogen atom, an alkyl group, an alkenyl group, an aryl group, an alkoxy group, an aryloxy group, an alkylthio group, an arylthio group, an amino group or a hydroxy group; and $R_2$ and $R_3$ in formula (I), which may be the same or different, each represents a hydrogen atom, a halogen atom, an alkyl group, an aryl group, an alkoxy group, an aryloxy group, an alkylthio group, an arylthio group, an acyloxy group, an amino group, a carbonamido group, a ureido group, a carboxy group, a carbonic acid ester group, an oxycarbonyl group, a carbamoyl group, an acyl group, a sulfo group, a sulfonyl group, a sulfinyl group, a sulfamoyl group, a cyano group or a nitro group.

5. The silver halide photographic material as in claim 1, wherein $R_1$ and $R_2$ or $R_3$ in formula (I) combine with each other to form a 5-membered, 6-membered or 7-membered carbon ring or a 5-membered, 6-membered or 7-membered heterocyclic ring containing at least one nitrogen atom, oxygen atom or sulfur atom.

6. The silver halide photographic material as in claim 1, wherein $R_4$, $R_5$, $R_6$, $R_7$ and $R_8$, which may be the same or different, each represents a hydrogen atom, an alkyl group, an alkenyl group, an aryl group, an alkoxy group, an aryloxy group, an acyloxy group, an amino group, a carbonamido group, a ureido group, an oxycarbonyl group, a carbamoyl group, an acyl group, a sulfonyl group, a sulfinyl group, a sulfamoyl group, a cyano group or a nitro group.

7. The silver halide photographic material as in claim 1, wherein the emulsion layer contains at least one compound represented by formula (I), (II) or (III) in an amount of from $5\times10^{-7}$ to $1\times10^{-2}$ mole per mole of silver halide.

8. The silver halide photographic material as in claim 1, wherein the hydrophilic colloid layer adjacent to the emulsion layer contains at least one compound represented by formula (I), (II) or (III) in an amount of from $1\times10^{-5}$ to $2\times10^{-3}$ mole per mole of silver halide in the emulsion layer.

* * * * *